US006297791B1

(12) United States Patent
Naito et al.

(10) Patent No.: US 6,297,791 B1
(45) Date of Patent: Oct. 2, 2001

(54) ADJUSTMENT METHOD OF DISPLAY DEVICE

(75) Inventors: Keijiro Naito, Matsumoto; Kazuto Shinohara, Suwa, both of (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/196,156

(22) Filed: Nov. 20, 1998

(30) Foreign Application Priority Data

Nov. 21, 1997 (JP) ..... 9-337874

(51) Int. Cl.[7] ..... G09G 3/36
(52) U.S. Cl. ..... 345/89; 345/102; 345/147
(58) Field of Search ..... 345/89, 87, 147, 345/102; 349/25, 29, 173; 359/56, 72, 44, 291, 292

(56) References Cited

U.S. PATENT DOCUMENTS 5,130,830 * 7/1992 Fukushima et al. ..... 359/72
5,162,785 * 11/1992 Fagard ..... 345/87
5,221,980 * 6/1993 Yamamoto et al. ..... 359/56
5,298,892 * 3/1994 Shapiro et al. ..... 345/88
5,327,263 * 7/1994 Katagiri et al. ..... 358/471
5,548,420 * 8/1996 Koshimizu et al. ..... 359/44
5,856,814 * 1/1999 Yagyu ..... 345/89
6,037,922 * 3/2000 Yagyu ..... 345/89

* cited by examiner

*Primary Examiner*—Steven Saras
*Assistant Examiner*—Fritz Alphonse
(74) *Attorney, Agent, or Firm*—Oliff & Berridge, PLC

(57) ABSTRACT

A display device performs various types of adjustment by canceling luminance dispersion caused by a light source at the time of optical illumination from the light source and correctly sets a gamma correction characteristic even when optical power from the light source varies or is abnormal. In luminance measurement of a display device, an adjustment method includes measuring transmitted light using a sensor and a reference sensor, calculating correction values on the basis of fluctuation values of reference data derived from measured data by the sensor and the reference data by the reference sensor, correcting the measured data, and thereafter converting the data into gradation values.

25 Claims, 19 Drawing Sheets

| Input Xm | R256 Ym(R) | G256 Ym(G) | B256 Ym(B) |
|---|---|---|---|
| 0 | 0 | 0 | 0 |
| 32 | 3 | 3 | 3 |
| 64 | 8 | 8 | 5 |
| 96 | 20 | 26 | 20 |
| 128 | 56 | 61 | 61 |
| 160 | 113 | 115 | 117 |
| 192 | 192 | 179 | 189 |
| 224 | 236 | 236 | 235 |
| 255 | 255 | 255 | 255 |

| GRADATION Xm | REFERENCE DATA Ref | CORRECTION VALUE | MEASURED DATA Mes | CORRECTION FREQUENCY Lux |
|---|---|---|---|---|
| n | 100 | +0 | 80 | 80 |
| n+1 | 105 | −5 | 89 | 85 |
| n+2 | 97 | +3 | 93 | 96 |

ADJUSTMENT METHOD OF DISPLAY DEVICE

BACKGROUND OF THE INVENTION

1. Field of Invention

The present invention relates to a display device, and in particular, to an adjustment method of a display device that does not emit light by itself, that is, a display device having a light source and an optical modulating device.

2. Description of Related Art

As display devices each using a light source for display and an optical modulating device, for example, liquid crystal display devices, electro-luminescence (EL), digital micro-mirror devices (DMD), and the like are known. In these display devices, for example, liquid crystal display devices, various types of adjustment shown below are performed as a process in a manufacturing phase in a production line of fabrication. Here, as an example, the above-described various types of adjustment methods in the case of displaying in a normally white mode in an active matrix liquid crystal display device using TFTs (thin film transistors) as pixel switches, and the general relationship between the optical power and the applied voltage will be described.

In general, in a TFT liquid crystal display device, one of two substrates where liquid crystal is sealed is processed as a TFT active matrix substrate, and the other substrate is processed as a counter substrate and a common electrode is formed. Furthermore, on the TFT active matrix substrate, pixel electrodes, which are connected to respective TFTs that are pixel switches, are formed. Moreover, a signal voltage is applied to this pixel electrode, a constant common voltage is applied to the common electrode on the counter substrate, and a differential voltage between the common voltage to the common electrode and the signal voltage to the pixel electrode is applied to each liquid crystal that is each pixel.

In addition, in the display method in the normally white mode, as shown in FIG. 17, the smaller the differential voltage between the signal voltage and common voltage is, the brighter the image display is, and the larger the differential voltage is, the darker the image display is. Here, in a graph of FIG. 17, the vertical axis shows the transmittance ratio T (brightness), the horizontal axis shows the voltage V (positive voltage: +, and negative voltage: −), and the graph shows the relationship between these voltages and the counter substrate voltage, and the transmittance ratio. Thus, in a liquid crystal display device, if the differential voltage from the counter substrate voltage is small in the liquid crystal display device, the transmittance ratio is high and thereby the image display is bright, and if the differential voltage from the counter substrate voltage is large, the transmittance ratio is low and thereby the image display is dark.

FIG. 18 shows changes of the signal voltage in the case of driving the liquid crystal through reversing the polarity of the voltage applied to the liquid crystal. Thus, FIG. 18 shows changes of voltages that both of a picture signal 2 that has a positive polarity in the case of positive polarity driving against the common voltage 1 in the image display and a picture signal 3 that has a negative polarity in the case of negative polarity driving.

In this type of liquid crystal display device, adjustment of the common voltage to the common electrode (this is called common adjustment) exists as a first adjustment item. This is to adjust the common voltage 1 applied to the common electrode on the counter substrate shown in FIG. 18, and images without flicker on a screen can be obtained by this adjustment.

As a second adjustment item, there is contrast adjustment or dynamic-range adjustment. This is to adjust a contrast ratio by simultaneously adjusting an amplitude VA between the maximum value 2A and minimum value 2B of the voltage, which the picture signal 2 having a positive polarity has, and an amplitude VB between the minimum value 3A and maximum value 3B of the voltage, which the picture signal 3 having a negative polarity has, of those signals which are shown in FIG. 18.

As a third adjustment item, there is DC offset adjustment. This is adjustment of setting an area to which a voltage is applied in the applied-voltage vs optical power characteristic described later and which determines a screen condition given to a user, and adjustment of a DC level with keeping a voltage amplitude of the picture signal constant.

This is to adjust the voltage VC between the maximum value 2A of the voltage, which the positive-polarity picture signal 2 shown in FIG. 18 has, and common voltage 1 and an absolute value of the voltage VD between the minimum value 3 A of the voltage, which the negative-polarity picture signal 3 has, and common voltage 1 to equal offset voltages. Thus by adjusting these offset voltages while looking at a picture displayed on a liquid crystal panel or a color picture on a projector screen in case of a projector, respective color levels in the cases of positive-polarity driving and negative-polarity driving are determined simultaneously. Generally, this DC offset adjustment is performed in the state of the positive display on the liquid crystal panel, and hence this is also called white-balance adjustment.

As a fourth adjustment item, setting of a gamma correction characteristic exists. A liquid crystal display device comprises a gamma correction circuit in a data processor. As shown in FIG. 19(A), first, the inherent applied voltage (V) vs transmittance ratio (T) characteristic of the liquid crystal panel is measured. Then, the gamma correction characteristic shown in FIG. 19(B) is determined as correction data necessary for correcting this inherent applied voltage vs transmittance ratio characteristic of the liquid crystal panel to a linear characteristic shown in FIG. 19(C). Furthermore, by obtaining such a linear input/output characteristic that is shown in FIG. 19(C) with synthesizing the gamma correction characteristic shown in FIG. 19(B) with the applied voltage vs transmittance ratio characteristic obtained with luminance measurement shown in FIG. 19(A), the gamma correction is completed.

Here, when various types of adjustment described above are performed, it is necessary to apply light from a light source built in an actual product, for example, a backlight to a liquid crystal panel.

At this time, in this type of light source, as shown in FIGS. 2(A) and 2(B), brightness is not always constant. Here, although, in graphs shown in FIGS. 2(A) and 2(B), the vertical axes show the luminance (lux) in both graphs and the horizontal axes show the time in both graphs, the unit of the vertical axis in FIG. 2(A) is msec, but the unit of the vertical axis in FIG. 2(B) is sec.

Although the graphs in FIGS. 2(A) and 2(B) show the results of luminance measurement regarding different light sources as objects, luminance vs time characteristic waveforms of different light sources, as shown in FIGS. 2(A) and 2(B), are different because of manufacturing dispersion even if they have the same ratings, for example, luminance dispersion of discharge tubes such as metal halide lamps usually used as backlights is nearly 10% according to discharge states. In particular, this luminance dispersion, as seen from FIGS. 2(A) and 2(B), arises in a short time and/or a long time in some cases.

In this manner, if the optical power from a light source decreases or increases at the time of adjustment, measurement necessary for the third and forth adjustment items among the above-described adjustment items is hindered. Thus, when the DC offset adjustment and setting of the gamma correction characteristic are performed at the time when the optical power from the light source is abnormal, it becomes impossible to perform proper positive display and gamma correction at the time when the optical power from the light source is normal.

SUMMARY OF THE INVENTION

Then, an object of the present invention is to realize a fine-quality display device by correcting data obtained in the measurement for performing various types of adjustment of the display device in spite of luminance dispersion caused by the light source.

In addition, another object of the present invention is to further increase reliability of optical modulation by further performing the DC offset adjustment.

An adjustment method of a display device having a light source and an optical modulator modulating light from the light source on the basis of an applied voltage, may include:

- a first step of setting changes of the applied voltage according to different gradation values and measuring optical power at each of the gradation values that is modulated by the optical modulator at a position corresponding to at least a first pixel;
- a second step of setting the applied voltage, corresponding to a constant gradation value, every measurement in the first step and measuring a reference optical power modulated by the optical modulator at a reference position corresponding to a second pixel, the reference position being different from the position corresponding to the at least a first pixel; and
- a third step of correcting the optical power at each of the gradation values, which is measured in the first step, on the basis of the reference optical power measured in the second step.

Therefore, according to the adjustment method of a display device, by measuring reference optical power at the reference position obtained at the second step every measurement of the reference optical power at the time of modifying and setting the applied voltage at the first step, to refer to dispersion of the reference optical power, and owing to this, to measure the dispersion of the optical power by the light source qualitatively, and hence to generate ideal measured data in consideration of the dispersion of the optical power supplied by the light source by correcting the optical power obtained at the first step on the basis of the optical power measured according to the respective gradation values. Measurement of these two types of optical power need not be at the exact same timing, but the measurement of these two types of optical power can be performed by switching them at a short interval. In short, when measuring the optical power with modifying and setting the applied voltage, any timing is good so long as the optical power of the light source itself used for the measurement of the optical power can be measured as the reference optical power.

An adjustment method of a display device may include measurement under setting the applied voltage corresponding to the maximum gradation value is performed at the second step.

Therefore, it is possible to measure the relative dispersion of the optical power of the light source by setting the above-described reference position at the applied voltage corresponding to the maximum gradation value at the time of each measurement.

An adjustment method of a display device may be performed with a plurality of types of optical modulators and the above-described measurement is performed for every optical modulator. Therefore, according to the adjustment method of a display device, it is possible to perform color display by using the plural types of optical modulators, and hence to correct the optical power obtained at the first step in consideration of the dispersion of production of respective optical modulators and the dispersion of the optical power supplied by the light source.

An adjustment method of a display device having a light source and an optical modulator modulating light from the light source on the basis of an applied voltage may include:

- a first step of changing and setting the applied voltage according to different gradation values and measuring an optical power at each of the gradation values that is modulated by the optical modulator and corresponds to at least one pixel;
- a second step of measuring a reference optical power from the light source for every measurement in the first step; and
- a third step of correcting the optical power at each of the gradation values that is measured in the first step on the basis of the reference optical power measured in the second step.

Therefore, according to an adjustment method of a display device, by measuring the reference optical power before reaching the optical modulator at the second step, it becomes possible to measure the dispersion of the optical power every measurement qualitatively that is supplied by the light source, and it becomes possible to correct the optical power obtained at the first step in consideration of the dispersion of the light source by comparing and referring to the reference optical power measured and the optical power measured every gradation. In addition, this second step can be performed with using reference light measuring means located inside the display device.

The adjustment method of a display device may include a step of comparing the reference optical power measured at the time of a first measurement and respective reference optical power obtained at the time of respective measurements after the first measurement and calculating respective correction values based on the comparison.

Therefore, according to the adjustment method of a display device, since a correction value can be calculated every measurement from each reference optical power obtained at the time of each measurement with reference to the reference optical power obtained at the time of the first measurement, it is possible to reflect the dispersion of optical power of the light source in the correction value.

The adjustment method of a display device may include a step of comparing a mean value of the reference optical power measured during respective measurements with the values of respective reference optical power obtained at the time of respective measurements and calculating respective correction values based on the comparison.

Therefore, according to the adjustment method of a display device, since a correction value can be calculated every measurement from each reference optical power obtained at the time of each measurement with reference to the mean value of the reference optical power obtained at the time of respective measurements, it is possible to reflect the dispersion of optical power of the light source in the correction value.

The adjustment method of a display device, may include a step of comparing an initial value of the reference optical power defined as a standard reference optical power with respective reference optical powers obtained at the time of respective measurements and calculating respective correction values based on the comparison.

Therefore, according to the adjustment method of a display device, since it is possible to calculate a correction value every measurement from each reference optical power obtained at the time of each measurement with reference to the initial value of the reference optical power, it is possible to reflect the dispersion of optical power of the light source in the correction value.

The adjustment method of a display device may include a step of converting the corrected optical power into a gradation values.

Therefore, according to the adjustment method of a display device, by converting the corrected optical power into gradation values, it is possible to obtain the gradation values in consideration of the dispersion of optical power of the light.

The adjustment method of a display device may include a step of determining a gamma characteristic on the basis of respective correction values obtained at the third step.

Therefore, according to the adjustment method of a display device the correction values may be calculated before the gamma correction, and it is possible to make the data, where the dispersion of optical power of the light source is reflected, the basic data for the gamma correction, and hence it is possible to obtain the further high-precision gamma correction characteristic.

The adjustment method of a display device may include:

a step of correcting digital data in a gamma correction circuit where the gamma correction characteristic is set and where input data is changed into the digital image data for application to an applied voltage vs optical modulation characteristic in the optical modulator;

a step of converting the digital image data into analog image data with a DA converter;

a step of amplifying the analog image data with an amplifier;

a step of displaying an image by driving the optical modulator for modulation on the basis of the analog image data; and an adjustment step of extending a dynamic range of a display image by changing an amplification factor in the amplifier when the gradation value of the input digital image data to the gamma correction circuit is a largest value and the gradation value of output digital image data from the gamma correction circuit is smaller than the largest value.

Therefore, according to the adjustment method of a display device, a bias adjustment may be performed after DA conversion, to increase the gain of an image signal, and to increase the contrast ratio of the display device.

The adjustment method of a display device may include an amplifier constructed of an operational amplifier that changes a bias potential supplied to the operational amplifier.

Therefore, according to the adjustment method of a display device, since it is possible to easily perform bias adjustment after DA conversion with the amplifier, it is possible to increase the gain of an image signal, and to increase the contrast ratio of the display device.

The adjustment method of a display device may include:

a step of changing digital data into digital image data for application to an applied voltage vs optical modulation characteristic in an optical modulator by correcting the digital data with a gamma correction circuit where the gamma correction characteristic is set;

a step of converting the digital image data, which is corrected by the gamma correction circuit, into analog image data with a DA converter on the basis of a reference voltage;

a step of amplifying the analog image data with an amplifier;

a step of displaying an image by driving the optical modulator for modulation on the basis of the analog image data; and an adjustment step of extending a dynamic range of a display image by changing the reference voltage of the DA converter when the gradation value of the input digital image data to the gamma correction circuit is a largest value and the gradation value of output digital image data from the gamma correction circuit is smaller than the largest value. Therefore, according to the adjustment method of a display device, since it is possible to adjust the reference voltage of the DA converter, it is possible to perform gain adjustment in the DA converter, and hence to increase the contrast ratio of the display device.

The adjustment method of a display device may include:

a step of changing digital data into digital image data for application to an applied voltage vs optical modulation characteristic in an optical modulator by correcting the input digital data with a gamma correction circuit where the gamma correction characteristic is set;

a step of converting the digital image data, which is corrected by the gamma correction circuit, into analog image data with a DA converter on the basis of a reference voltage;

a step of setting a voltage corresponding to a smallest gradation value among the analog image data at a predetermined clamp voltage in a clamp circuit;

a step of displaying an image by driving the optical modulator for modulation on the basis of the analog image data; and a step of adjusting a white balance by changing the clamp voltage in the clamp circuit and hence adjusting a DC offset amount of the analog image data to the reference voltage.

Therefore, according to the adjustment method of a display device as defined in claim 14, since it is possible to adjust the DC offset amount with the clamp circuit, it is possible to adjust white balance of the display device.

The adjustment method of the display device may be performed on a projection-type display device, with the measurement at the first step performed for the pixels on a display screen, and further the measurement at the second step is performed for the pixels at the reference positions on the screen.

Therefore, it is possible to adjust the projection-type display device, and hence to increase image quality of the projection-type display device.

DETAILED DESCRIPTION OF PREFERRED EMBODIMENTS

Hereinafter, embodiments of the present invention will be described with reference to the drawings. First, the outline of a display device to which the adjustment of the present invention is performed will be described.

Figure 3:
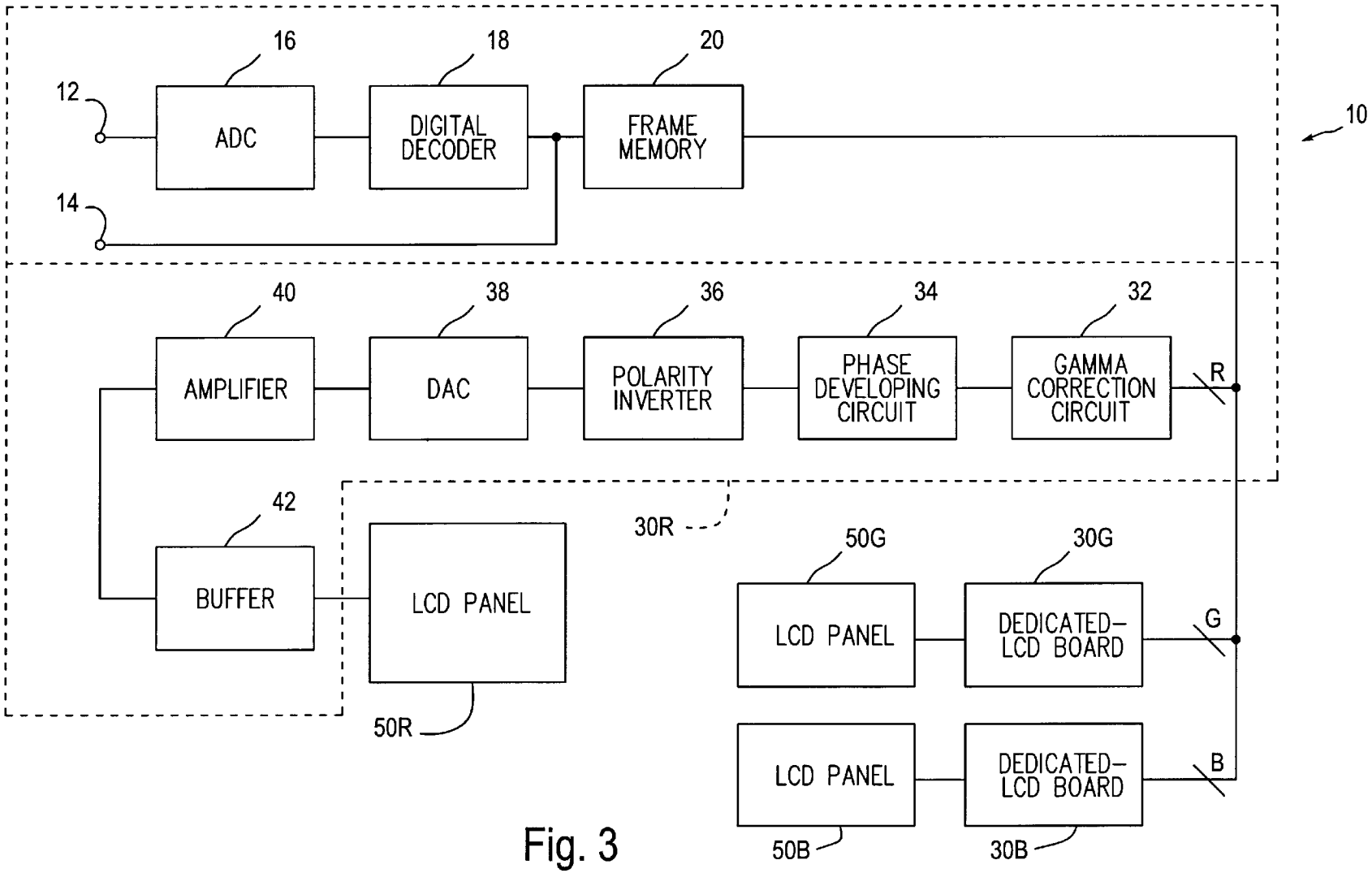
FIG. 3 is a block diagram showing the whole of a display device applying the present invention to a projector.

FIG. 3 is a block diagram schematically showing an entire display device for driving a liquid crystal display panel. The liquid crystal display device of this embodiment that is shown in FIG. 3 is applied to a projector using three liquid crystal display panels as light valves for R, G, and B respectively. In addition, although, in this embodiment, three liquid crystal display panels are constructed by active matrix substrates using TFTs as switching elements, it is possible to use other-type liquid crystal display substrates.

In FIG. 3, with broadly dividing components, the liquid crystal display device of this projector has a signal processing board 10 used for data processing of respective colors, red (hereinafter, this is expressed as R), green (hereinafter, G), and blue (hereinafter, B), dedicated liquid crystal display boards 30R, 30G, and 30B that are provided for respective colors, R, G, and B, and liquid crystal display panels 50R, 50G, and 50B respectively functioning as three light valves.

The signal processing board 10 can be a total control board in which various types of circuits (not shown) for the projector that is an electronic apparatus of this embodiment, and elements and circuits that realize the following functions are mounted.

First, as an input terminal of image data, the signal processing board 10 has a first input terminal 12 for inputting an analog TV signal such as NTSC or PAL, and a second input terminal 14 for inputting a digital image signal such as a computer output or a CDROM output. Here, although the analog TV signal inputted to the first input terminal 12 is gamma-corrected in consideration of a characteristic of a CRT, the digital image signal inputted to the second input terminal 14 is not gammacorrected. In addition, it is possible to provide another terminal for inputting a digital image signal gamma-corrected for a CRT such as a CCD camera output.

An AD converter 16 is connected to the first input terminal 12 to perform analog-digital conversion of a TV signal. Furthermore, a digital decoder 18 is connected to the AD converter 16. This digital decoder 18 decodes a luminance signal Y and color-difference signals U and V into three color signals, that is, R, G, and B signals.

In a subsequent stage to the digital decoder 18, frame memory 20 is provided. One frame of data inputted through the first input terminal 12 is written in the frame memory 20 through the AD converter 16 and digital decoder 18. The digital data R, G, and B are inputted through the second input terminal 14 and are directly written in the frame memory 20. In addition, if interlaced scanning is performed in the liquid crystal display panels 50R, 50G, and 50B, respective data of one frame of R, G, and B are read in the order of an odd line and an even line from the frame memory 20, being separated into two fields.

Here, the structure of a liquid crystal drive IC that is mounted on the dedicated liquid crystal display board 30R and is shown in detail in FIG. 3 is the same structure as the liquid crystal drive ICs that are not shown and are used for displaying other colors, G and B on the dedicated liquid crystal display boards 30G and 30B.

A gamma correction circuit 32 is provided in the dedicated liquid crystal display board 30R. In addition, in the subsequent stage to the gamma correction circuit 32, a phase developing circuit 34 is provided. This phase developing circuit 34 performs phase development of data for lowering a drive frequency in the liquid crystal display panel 50R.

In the subsequent stage to the phase developing circuit 34, a polarity inverter 36 is provided. The polarity inverter 36 is provided for performing polarity inversion and drive by inverting the polarity of an electric field applied to liquid crystal of each pixel of the liquid crystal display panel 50R at a predetermined period. Since, in this embodiment, switching elements on the liquid crystal display panel are constructed with TFTs, the polarity of data potential supplied to pixels is inverted and driven at a predetermined timing with reference to the potential of a common electrode formed on a substrate facing the TFT substrate. For the sake of this, the polarity inverter 36 generates and outputs data having the positive potential to the potential of the common electrode and data having the negative potential.

In the subsequent stage to the polarity inverter 36, a DA converter 38 is provided to perform digital-analog conversion of N lines of polarity-inverted data respectively. This analog signal becomes an output of the liquid crystal display drive IC.

In addition, in the liquid crystal display drive IC, a timing generator not shown is provided to generate timing signals necessary for the phase developing circuit 34, polarity inverter 36, and DA converter 38 on the basis of an image synchronization signal.

An amplifier 40 and a buffer 42 are further provided in the dedicated liquid crystal display board 30R. Data on which a bias voltage corresponding to negative and positive polarity inversion and drive is superimposed in the amplifier, for example, an operational amplifier 40, is supplied to the liquid crystal display panel 5OR through the buffer 42, and the liquid crystal display panel 5OR is polarity-inverted and driven every predetermined period such as one dot or one line on the basis of this data.

The main purpose of the gamma correction circuit 32 is to perform gamma correction suitable to the applied-voltage vs transmittance ratio characteristic of each liquid crystal display panel. Since this applied-voltage vs transmittance ratio characteristic is different for every liquid crystal display panel, it is necessary to be absolutely adjusted as described later. Since an adjusting step becomes simple and convenient by constructing this gamma correction circuit 32 with the display panel in one-piece through mounting this gamma correction circuit 32 on the dedicated liquid crystal display board, calculation is made simple, and hence high-precision correction can be performed.

Figure 1A:
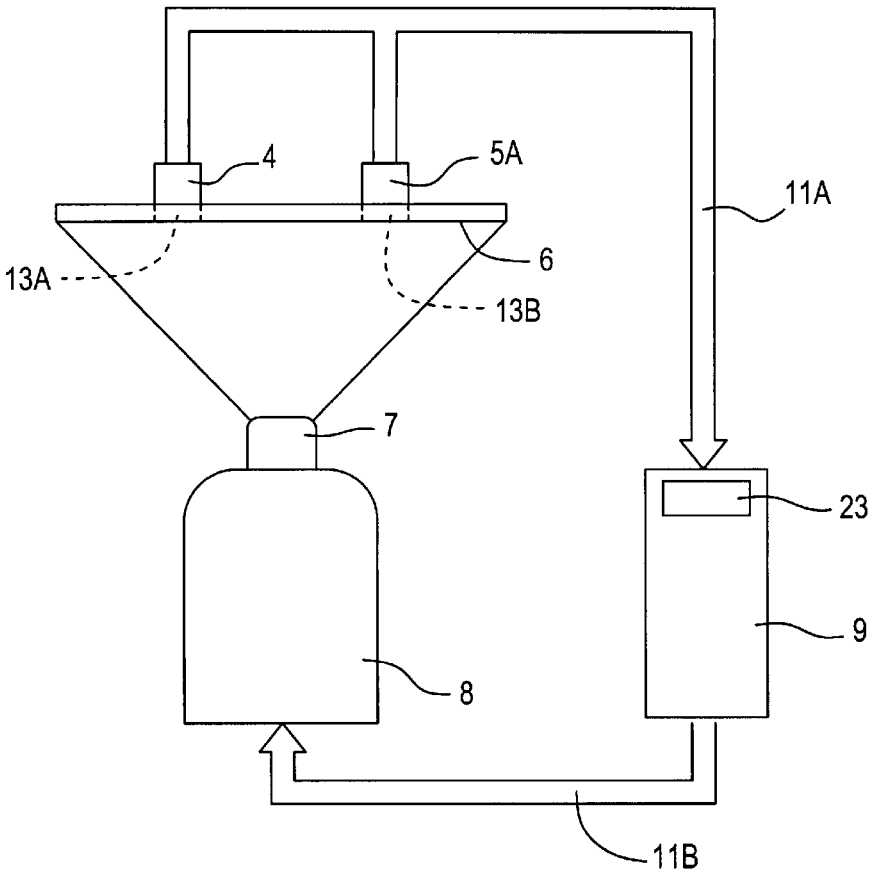
FIG. 1(A) is a schematic diagram of a luminance measuring instrument for measuring the applied voltage vs optical power characteristic of a first embodiment that is an example of applying the present invention to a projector.
Figure 1B:
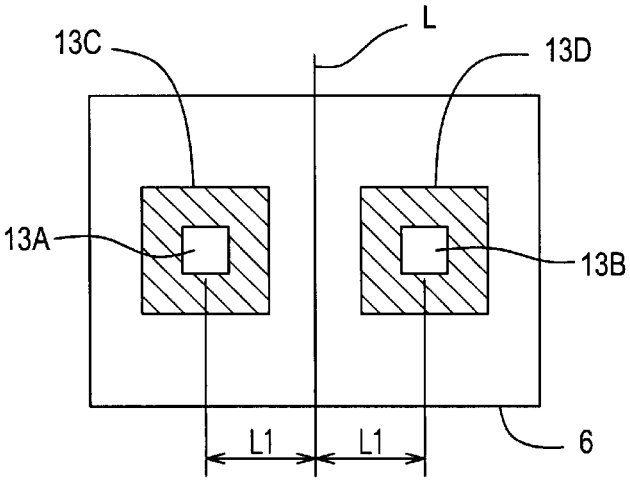
FIG. 1(B) is a front view of a screen shown in FIG. 1(A)
Figure 1C:
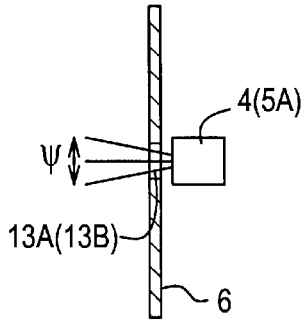
FIG. 1(C) is a cross section of the screen.

FIGS. 1(A) through 1(C) show schematic diagrams of a luminance measuring instrument for a display device of a first embodiment of the invention. In the first embodiment, as for luminance measurement of a liquid crystal display device, for example, a projector, measurement is performed by each of panels R, G, and B, and this measurement, as shown in FIG. 1(A), is performed using a gradation-value measuring instrument 9, a sensor 4 and a reference sensor 5A by projecting an image of every color of R, G, and B from the projector 8 to a projector screen 6 through the lens 7.

At this time, light transmission means 13A and 3B are provided in the projector screen so that light from the projector 8 may directly enter the sensors 4 and 5A. Furthermore, in order to measure the luminance of the light on the projector screen 6, the sensors 4 and 5A are installed contacting the light transmission means 13A and 13B on the projector screen 6.

Here, the light transmission means 13A and 13B are for the light emitted from the projector 8 being not cut off by the projector screen 6, and the means can be constructed by, for example, means of partially providing a hole or partially making the screen clear.

FIG. 1(B) shows an example of a projector screen 6 having openings 13A and 13B as the light transmission means. It is preferable to provide these openings 13A and 13B in line symmetry at positions lie away from a vertical center line L of the screen 6, respectively. This is because an optical system of a projector is designed so that illuminations may become equal at respective positions in line symmetry to the vertical centerline L of the screen 6.

Furthermore, as shown in FIG. 1(B), it is preferable to display hatched areas 13C and 13D, that are shown in the drawing, in a black color around respective openings 13A and 13B and to use these areas as masks. Thus, as shown in FIG. 1(C), although respective sensors 4 and 5A receive light within the range of an angle ψ, it is possible for the light except measured light not to enter into respective sensors 4 and 5A with the masks 13C and 13D.

In addition, the reference sensor 5A uses devices having the same specification as that of the sensor 4, and a display having constant gradation such as white display is always performed on pixels that are projected at the position corresponding to the reference sensor 5A on the projector screen 6, and reference data is measured.

As for measurement of luminance at the sensor 4, the sensor 4 measures luminance every gradation through changing the gradation of the display area corresponding to the opening 13A. Thus, owing to this, a correlation between the voltage applied to liquid crystal corresponding to each gradation and the transmittance ratio of the liquid crystal to which the voltage is applied is measured.

The sensor 4 and reference sensor 5A are connected to the gradation-value-measuring instrument 9 through a cable 11A, measured data Mes measured by the sensor 4 and reference data Ref measured by the reference sensor 5A are inputted respectively to the gradation-value-measuring instrument 9, correction of the measured data Mes on the basis of the reference data Ref and luminance value vs gradation value conversion of corrected luminance value Lux calculated from the correction are performed, and a corrected-gradation value Data is calculated.

In addition, in order to perform luminance measurement by sensors 4 and 5A, a gradation value of an image projected on the projector screen 6 is changed every measurement only in the area of the opening 13A, a white display is always projected in the area of the opening 13B, and black display is always performed in the mask areas 13C and 13D. Therefore, at the time of luminance measurement, such image data that such a projection image can be displayed is supplied. In addition, modified examples of the display method of a projected image at the time of luminance measurement will be described later with reference to FIGS. 20 and 21.

In addition, although, at the time of luminance measurement by the sensors 4 and 5A, simultaneous sampling can be performed by synchronizing both sensors 4 and 5A with each other, the measurement can be performed alternately once or a plurality of times by switching luminance sampling by the sensors 4 and 5A in a short time.

In the luminance measurement, light incident to the sensor 4 and reference sensor 5A is photoelectrically converted, and is outputted as respective electric signals to a first data bus formed with the cable 11A o be inputted to the gradation-value-measuring instrument 9, and the corrected luminance Lux is calculated with a method described later on the basis of the measured data Mes obtained by respective measurements and respective reference data Ref through data processing in the gradation-value-measuring instrument 9. After that, respective corrected-gradation values Data calculated with normalizing the respective corrected luminance Lux are outputted to a second data bus formed with the cable 11B to be fed back to the projector 8.

Then, the corrected-gradation values Data are inputted respectively to a data correction circuit 23 in a data processor installed in the projector 8, and the gamma correction characteristic is determined on the basis of this corrected-gradation values Data. Furthermore, gamma correction of input digital data is performed on the basis of the gamma correction characteristic stored in, for example, ROM or RAM by the gamma correction circuit 32 shown in FIG. 1.

As described in the luminance measurement method, the luminance measured by the sensor 4 and reference sensor 5A that are shown in FIG. 1 is converted into the corrected luminance by the gradation-value-measuring instrument 9, and thereafter is reduced to normalized data.

Figures 4A, 4B:
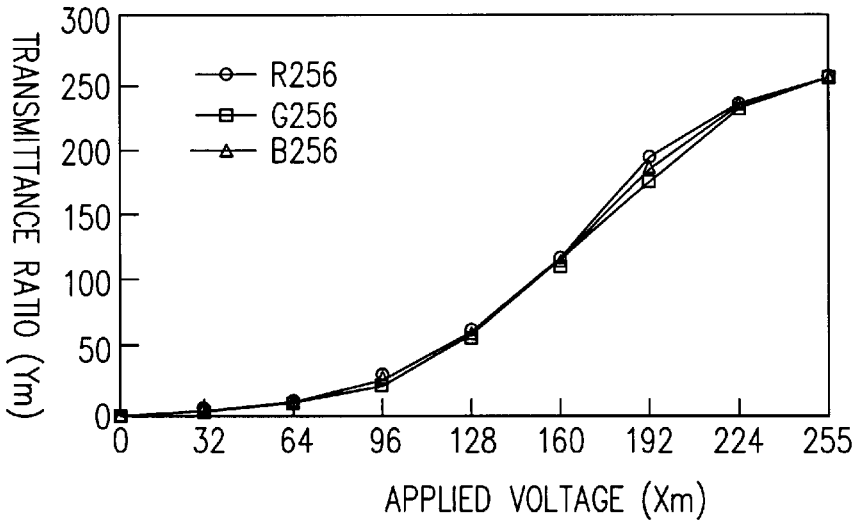
FIGS. 4(A) and 4(B) are a data characteristic table and its graph of an example expressed by normalizing respectively correction luminance values obtained by correcting measured data of optical power, which are the luminance of the light sources built in the projector, which are measured every 32 gradation steps by the adjustment method according to the present invention, on the basis of reference data.

FIG. 4(A) shows a table of gradation values calculated from luminance of the light source built in the projector 8 in FIG. 1 and corrected-gradation values that are based on corrected luminance values Lux calculated from measured data every 32 gradations in the projector 8 and are normalized in the range of 0–255. In FIG. 4(A), corrected-gradation values Ym(R), Ym(G), and Ym(B) to which respective corrected luminance values obtained by correcting transmittance ratios measured in respective panels R, G, and B are normalized are expressed against a raster signal Xm that is a liquid crystal panel drive signal as an input signal. Here, the raster signal Xm is drive signals Xm(R), Xm(G), and Xm(B) corresponding to respective panels R, G, and B. They are individual, and measurement of each raster signal by each of panels R, G, and B is performed, but, for convenience of data processing, these are expressed as the raster signal Xm in FIG. 4(A).

Thus, respective numbers in the table of FIG. 4(A) are expressed in respective gradation values with correcting respective measured data of luminance of the light passing through respective panels R, G, and B and thereafter normalizing them. In this normalization, it is defined that the maximum value of a corrected-gr, dation value is 255 and the minimum value is 0, and, for example, in each measured data, let the maximum value of the corrected-gradation value of R be Rmax, let the minimum be Rmin, and let each corrected-gradation value be Rx, let the maximum value of the corrected-gradation value of G be Gmax, let the minimum be Gmin, and let each corrected-gradation value be Gx, and let the maximum value of the corrected-gradation value of B be Bmax, let the minimum be Bmin, and let each corrected-gradation value be Bx, and corrected-gradation values Ym(R), Ym(G), and Ym(B) of R, G, and B are calculated by formulas 1 through 3 that are shown below.

$$Ym(R)=255\times(Rx-Rmin)/(Rmax-Rmin) \quad (1)$$

$$Ym(G)=255\times(Gx-Gmin)/(Gmax-Gmin) \quad (2)$$

$$Ym(B)=255\times(Bx-Bmin)/(Bmax-Bmin) \quad (3)$$

Furthermore, since respective gradation values in the table of FIG. 4(A) are expressed in nine-step gradation, in 0 through 256, the interval of each gradation becomes 256/(9−1), and hence display is made to be every 32 gradation steps. Although, in FIG. 4(A), per-color corrected-gradation values Ym(R), Ym(G), and Ym(B) calculated using formulas 1 through 3 from measured data and corrected luminance values obtained by correcting the data are shown, FIG. 4(B) shows a graph of them. In FIG. 4(B), the vertical axis is the corrected-gradation values Ym(R), Ym(G), and Ym(B) of light passing through respective panels R, G, and B, the horizontal axis is the gradation value Xm of a raster signal, and three graphs showing respective corrected-gradation values in the respective panels R, G, and B are shown.

In this manner, since three panels of R, G, and B are used in color display by a liquid crystal display device such as a projector, respective corrected-gradation values Ym(R), Ym(G), and Ym(B) in regard to these three panels are calculated from respective measured data of luminance and correction described later.

Although the present invention, as described above, can adjust a display device with the method, since, conventionally, adjustment with the method of the invention of calculating corrected luminance values through correcting measured data using reference data and thereafter normalizing the data was not performed, gradation values were calculated only with simple luminance vs gradation value conversion of measured data and were used as the data that became objects of gamma correction, and visual adjustment was performed by projecting an image on a projector screen on the basis of the respective gradation values of light passing through respective panels R, G, and B.

Thus, as described above, since the relation between time and luminance in a light source is not constant but dispersion arises, in case a gradation value Xm of a raster signal in FIG. 4(A) is 96, and if the measured data of light passing through panels is, for example, 100 and the gradation value Xm of a raster signal is 128, a situation that the measured data of the light passing through the panels is, for example, 95 arises in some cases. In this case, since luminance does not increase proportionally to a gradation value and hence proportional relation collapses, the applied voltage vs optical power characteristic is not accurate even if the measured data itself is normalized. Therefore, if 98% is attempted to calculate against 100% when a point where luminance saturates is measured, reliability of the gradation value calculated is lowered if the luminance is shifted by 5% due to dispersion of the light source, and hence visual adjustment is necessary.

Figures 5, 6:
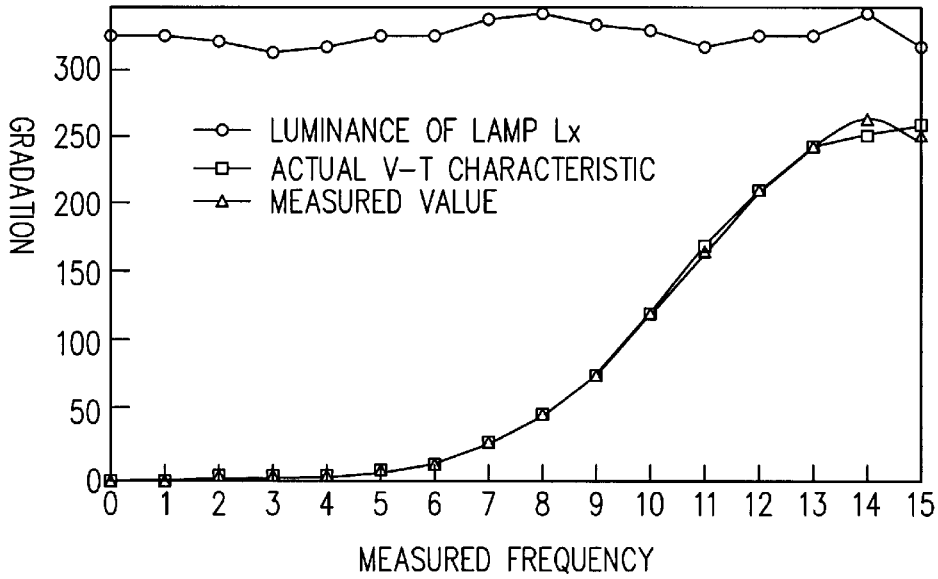
FIG. 5 is a graph showing the relationship between the luminance dispersion of the light source and the applied voltage vs optical power characteristic.
FIG. 6 is a characteristic table showing a numerical example of measured data Mes and correction luminance values Lux corrected on the basis of the reference data Ref.

For example, FIG. 5 shows a graph showing the dispersion of a light source and the time vs gradation characteristic of a projector. In FIG. 5, the horizontal axis shows the measured frequency of luminance of the projector, and the vertical axis shows the gradation. As shown in FIG. 5, the luminance of the light source is not constant every luminance measurement, and the luminance varies every measurement. For example, as it is apparent from FIG. 5, the gradation of a display panel in the projector also increases by the luminance of the light source increasing, and the gradation in the projector also decreases by the luminance of the light source decreasing.

Then, in this embodiment, by not only the measurement by the sensor 4 but also the measurement by the reference sensor 5A, as shown in FIG. 1, at the time of luminance measurement of a display device, luminance that becomes reference data is simultaneously measured, and correction is performed to the measured data.

Thus, in the case of measuring the per-gradation applied-voltage vs optical power characteristic, conventionally, data obtained by normalizing measured data itself without considering luminance dispersion of the light source that arose every measurement were stored as the applied-voltage vs optical power characteristic in a memory unit of a projector and the like, gamma correction was performed on the basis of this, and hence it was impossible to make the memory unit have suitable gamma correction data. Nevertheless, by performing measurement after adjusting a display device with the adjustment method of this embodiment, it becomes possible to give suitable gamma correction data by correcting the measured data Mes on the basis of correction values calculated from the reference data Ref and thereafter normalizing the data, and taking the corrected-gradation values Data obtained after the normalization as object data for gamma correction.

Three kinds of methods described below are listed as correction methods of this data.

(1) Per-measurement correction values are calculated by comparing respective reference data Ref to the reference data in the first measurement, Ref0 or the mean value RefA of respective reference data Ref, and the correction values are subtracted from the respective measured data Mes.

Here, let the reference data in the first luminance measurement, be Ref0, and measured data be Mes0, let measured data after correction be corrected luminance value, Lux0, and let subsequent measured data be Lux1, Lux2, . . . , Luxn. Then, each corrected luminance value Lux is calculated by formulas 4 through 7 shown below on the basis of each measured data Mes, each reference data Ref, and the reference data Ref0 obtained in the first measurement.

$$Lux0=Mes0 \tag{4}$$

$$Lux1=Mes1/[1+(Ref1-Ref0)/Ref0] \tag{5}$$

$$Lux2=Mes2/[1+(Ref2-Ref0)/Ref0] \tag{6}$$

$$Luxn=Mesn/[1+(Refn-Ref0)/Ref0] \tag{7}$$

According to this adjustment method, for example, as shown in a table of FIG. 6, if respective measured data Mes in measurements at n, (n+1), and (n+2) gradation steps of a raster signal are 80, 89, and 93, respective reference data Ref are 100, 105, and 97, the reference data Ref0 in the first measurement becomes 100. Therefore, with defining the reference data Ref0 at the n-gradation steps as a reference value, (Ref1−Ref0) becomes +5 at n-gradation steps and (Ref2−Ref0) becomes −3 at (n+2)-gradation steps, corrected-gradation values Lux are calculated as object data to be normalized, Lux0 is calculated at 80, Lux1 is at 84.76, and Lux2 is at 95.88.

Figure 2A:
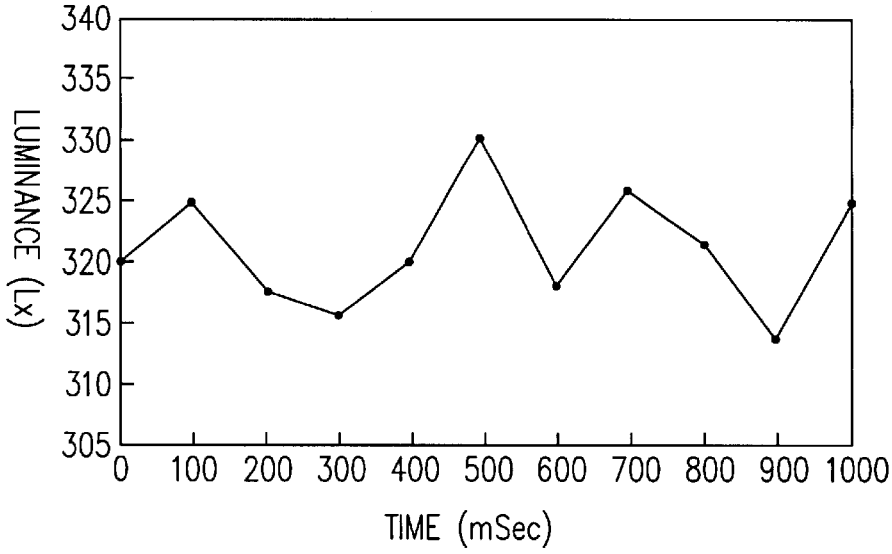
FIGS. 2(A) and 2(B) are graphs showing respectively the relationship between the time and luminance for two types of light sources applied to the projector.
Figure 2B:
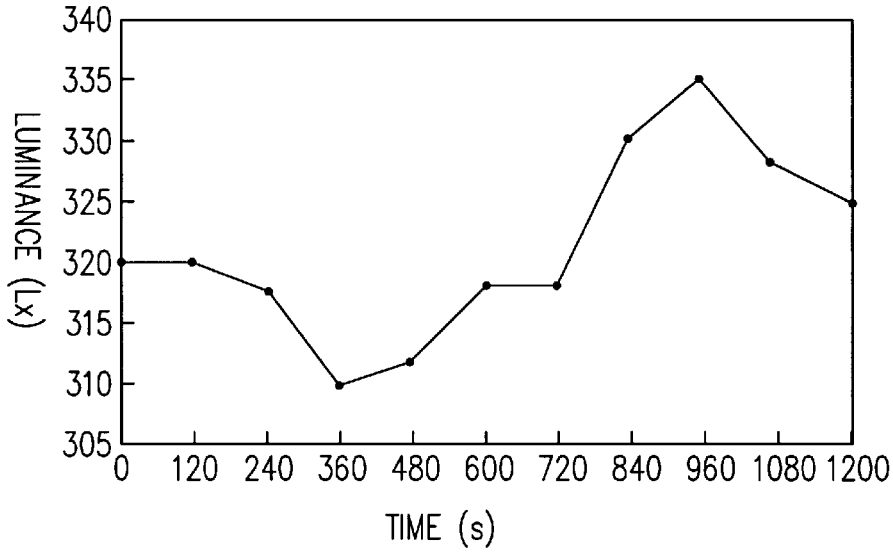

In addition, this correction method can be applied to a case, as shown in FIG. 2(B), that luminance of a lamp disperses for a comparatively long time and data acquisition is performed over a long time.

Furthermore, in case each corrected luminance value Lux is calculated using a mean value RefA of respective reference data Ref in each measurement, first, the mean value RefA of the reference data Ref is calculated by formula 8.

$$RefA=(Ref0+Ref1+Ref2+\ldots+Refn)/n \tag{8}$$

Then, each corrected luminance value Lux is calculated on the basis of the following formulas 9 through 12 using the mean value RefA of the reference data in the entire measurements instead of the reference data Ref0 in the first measurement that is defined as a reference in the above formulas 4 through 7.

$$Lux0=Mes0 \tag{9}$$

$$Lux1=Mes1/[1+(Ref1-RefA)/RefA] \tag{10}$$

$$Lux2=Mes2/[1+(Ref2-RefA)/RefA] \tag{11}$$

$$Luxn=Mesn/[1+(Refn-RefA)/RefA] \tag{12}$$

In addition, this correction method can be also applied to a case that the luminance of a lamp, as shown in FIG. 2(A), disperses even in a comparatively short time and data acquisition is performed over a short time. Data sampling at this case is performed, for example, ten times per 100 mS because data sampling itself needs 1 mS.

(2) To compare with fixed reference data RefX

In case reference data Ref have an initial value as a standard, each corrected luminance value Lux is calculated with using the following formulas 13 through 16 similarly to item (1) with defining the initial value as a fixed theory RefX.

$$Lux0=Mes0/[1+(Ref0-RefX)/RefX] \tag{13}$$

$$Lux1=Mes1/[1+(Ref1-RefX)/RefX] \tag{14}$$

$$Lux2=Mes2/[1+(Ref2-RefX)/RefX] \tag{15}$$

$$Luxn=Mesn/[1+(Refn-RefX)/RefX] \tag{16}$$

This method can be also applied to a case that, as shown in FIG. 2(A), the luminance of a lamp disperses during a comparatively long time and data acquisition is performed over a long time.

In this embodiment, by calculating and normalizing corrected luminance values with methods (1) and (2) or a combination thereof, respective corrected-gradation values Data that are applied-voltage vs transmittance ratio characteristics are stored as object data of gamma correction, and thereby it is possible to cancel measurement errors caused by fluctuation of optical power from a light source.

Correction of measured data, as described above, that refers to reference data is performed by a data correction circuit that is connected to the gamma correction circuit 32 in the projector 8 in FIG. 1, is provided in the gradation-value-measuring instrument 9, and is not particularly shown.

Figure 7:
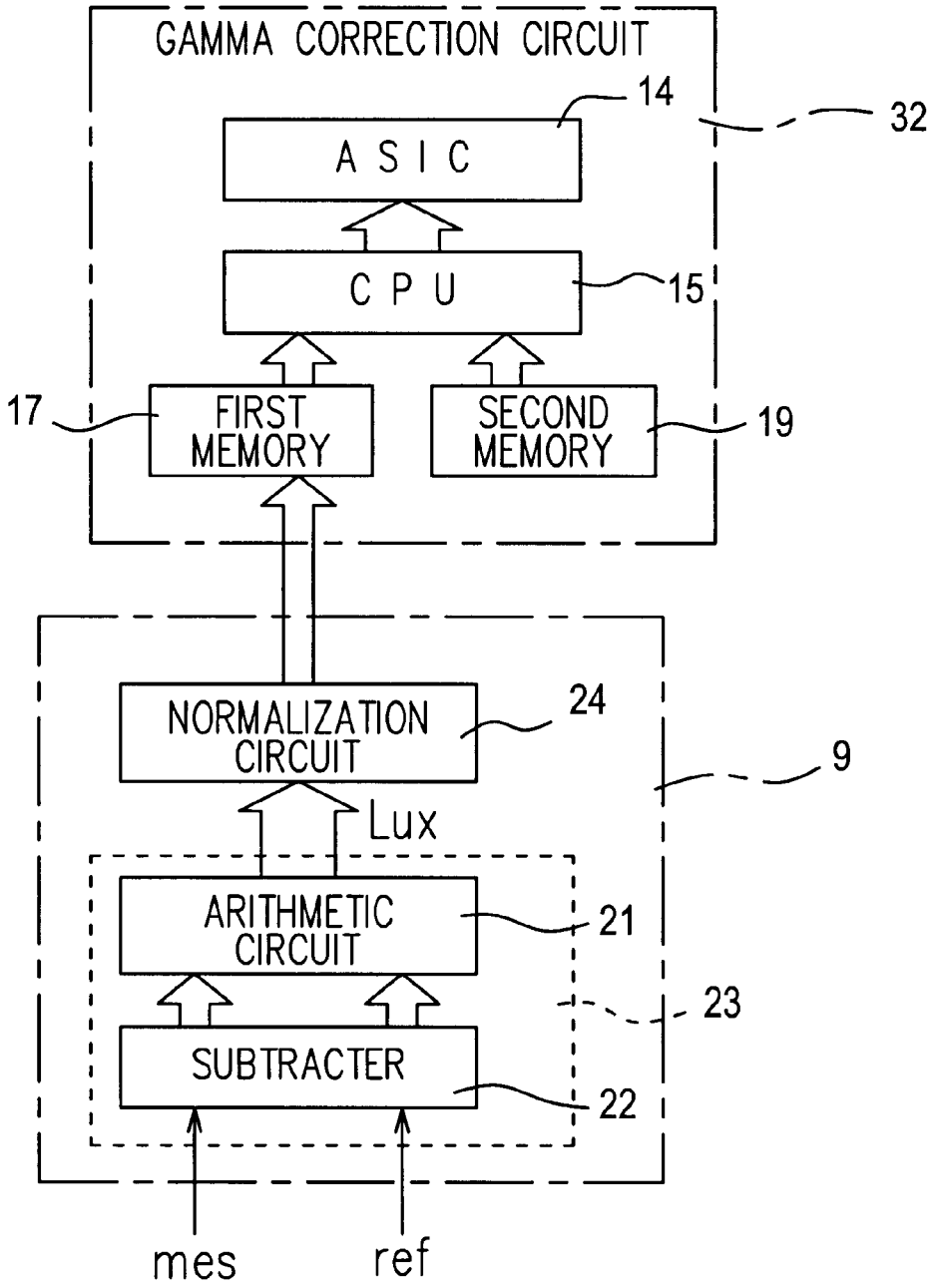
FIG. 7 is a block diagram showing the outline of circuit functions of a data correction circuit and a gamma correction circuit.

FIG. 7 shows the structure of the data correction circuit and gamma correction circuit, and data processing accompanying above-described calculation of the corrected-gradation values will be described.

The data correction circuit 23 has, for example, the subtractor 22 and arithmetic circuit 21, the per-measurement corrected-gradation value Lux is calculated by calculating any group of above-described formulas 4 through 7, 8 through 12, or 13 through 16 in the above-described subtractor 22 and arithmetic circuit 21. The output of the data correction circuit 23 is connected to a normalizing circuit 24 calculating the corrected-gradation values Data on the basis of above-described corrected-gradation values Lux.

The above-described subtractor 22 is a circuit supplying a measurement signal having respective measured data Mes inputted from the sensor and reference sensor every measurement as data and a reference signal ref having respective reference data Ref as data, to the gradation-value-measuring instrument 9 shown in FIG. 1, and a circuit calculating correction values by supplying these signals.

At this time, the above-described corrected-gradation values Lux are obtained with using any one of the abovedescribed methods (1) and (2) by subtracting the reference data Ref0 in the first measurement, mean value RefA of respective reference data Ref, or fixed reference data RefX that is set from the above-described reference data Ref.

In addition, this subtractor 22 can be constructed with, for example, an operational amplifier. At this time, a differential voltage that is obtained by analog digital conversion of the differential voltage amplified by the operational amplifier after an analog output from the sensor 5A being inputted to the operational amplifier can be used as data (Ref1−Ref0), (Ref1−RefA), or (Ref0−RefX).

The arithmetic circuit 21 calculates respective corrected-gradation values Lux on the basis of the respective measured data Mes and reference data Ref with using any one of above-described methods on the basis of correction values outputted from the subtractor 22.

Each corrected luminance value Lux calculated in the arithmetic circuit 21 is outputted to the normalizing circuit 24 as a corrected gradation signal lux having the value Lux as data and is normalized in the normalizing circuit 24 with the abovedescribed method, and a corrected-gradation value Data is calculated.

Then, the respective corrected-gradation values Data are stored by the respective corrected-gradation values Data being written in the first memory 17 in the gamma correction circuit 32. This first memory 17 can be preferably composed of non-volatile memory where data is rewritable.

Here, although an example of calculating using the subtractor and arithmetic circuit with taking calculation of formulas 4 through 16 as an example is shown, the present invention is not limited to this, but any type of circuit can be used so long as the circuit can realize the above-described operational functions, and, in FIG. 7, although the subtractor 22 and arithmetic circuit 21 are described as in separate blocks, it is, of course, possible to use a single circuit having two functions. Thus, with using a logic circuit, a microcomputer, or the like that has the operational function, it becomes possible to give the operational function by selecting and programming any group of the above-described formulas 4 through 7, 8 through 12, or 13 through 16.

By the way, this gamma correction circuit 32 comprises at least the first memory 17 storing respective corrected-gradation values Data, a second memory 19 storing ideal γ gradation values, a CPU 15 receiving the respective corrected-gradation values Data, and ideal γ gradation values and calculating a gamma correction curve, and an ASIC 14 having a gamma table.

Figure 19A:
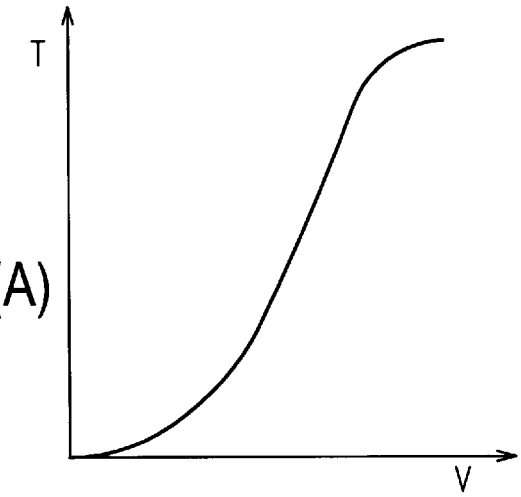
FIG. 19(*a*) is a graph showing the inherent applied voltage vs transmittance ratio characteristic of a liquid crystal panel measured.
FIG. 19(B) is a graph showing the applied voltage vs transmittance ratio characteristic as correction data necessary for correcting the inherent applied voltage vs transmittance ratio characteristic of the liquid crystal panel, and FIG. 19(*c*) is a graph showing the applied voltage vs transmittance ratio characteristic after gamma correction.
Figure 19B:
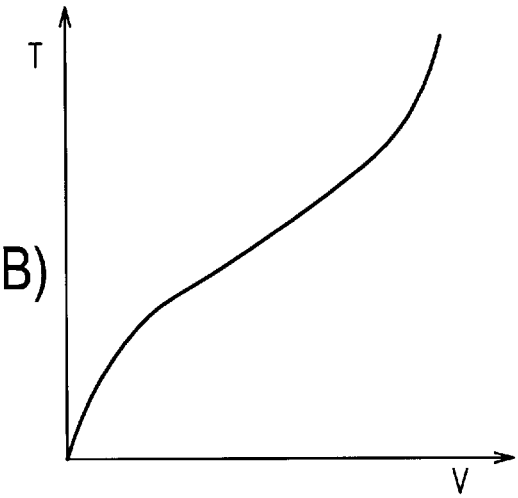
Figure 19C:
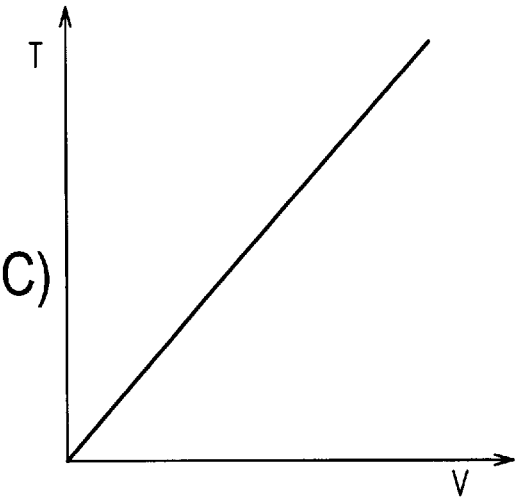

Thus, the applied-voltage vs transmittance ratio characteristic stored in the first memory 17 corresponds to a graph shown in FIG. 19(A), the applied-voltage vs transmittance ratio characteristic stored in the second memory 19 corresponds to a graph shown in FIG. 19(C), and the applied-voltage vs transmittance ratio characteristic stored in the ASIC 14 corresponds to a graph shown in FIG. 19(B).

In this manner, since accurate correction can be performed at the time of gamma correction because data for correcting the applied-voltage vs optical power characteristic due to dispersion of a light source in the gamma correction circuit in the data processor according to this embodiment, it is possible to increase reliability of a display device.

Figure 8:
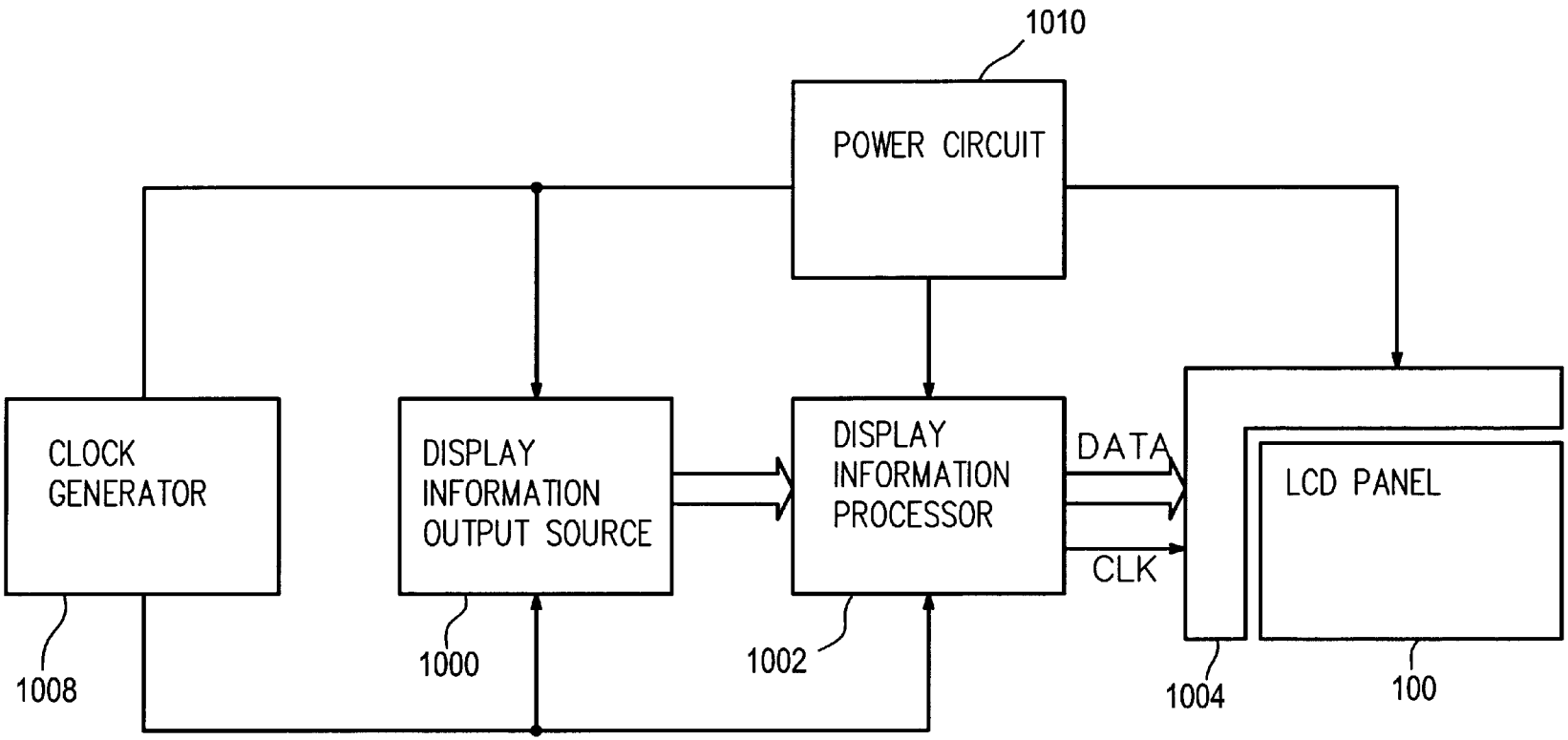
FIG. 8 is a schematic diagram of an electronic apparatus to which the present invention is applied.

A concrete example of a display device to which the above-described adjustment method of a display device according to the present invention is applied will be described below. For example, an electronic apparatus may include a display information output source 1000, a display information processor 1002, a display drive circuit 1004, a display panel 1006 such as a liquid crystal panel and the like, a clock generator 1008, and a power circuit 1010, which are shown in FIG. 8. The display information output source 1000 may include memory such as ROM and RAM, a tuning circuit tuning and outputting a TV signal, and the like, and outputs display information such as an image signal on the basis of a clock from the clock generator 1008 equivalent to the above-described timing circuit block 20.

The display information processor 1002 is equivalent to the above-described data processor block 30 of each embodiment, and processes and outputs the display information on the basis of the clock from the clock generator 1008. This display information processor 1002 can include the above-described gamma correction circuit, clamp circuit, and the like besides the amplification and polarity conversion circuit, phase developing circuit, rotation circuit, and the like.

The drive circuit 1004 may include a scanning side drive circuit 102, X driver 104, and precharge drive circuit 160, or only the X driver 104, and drives the liquid crystal panel 1006 for display. The power circuit 1010 supplies power to the above-described respective circuits.

Figure 9:
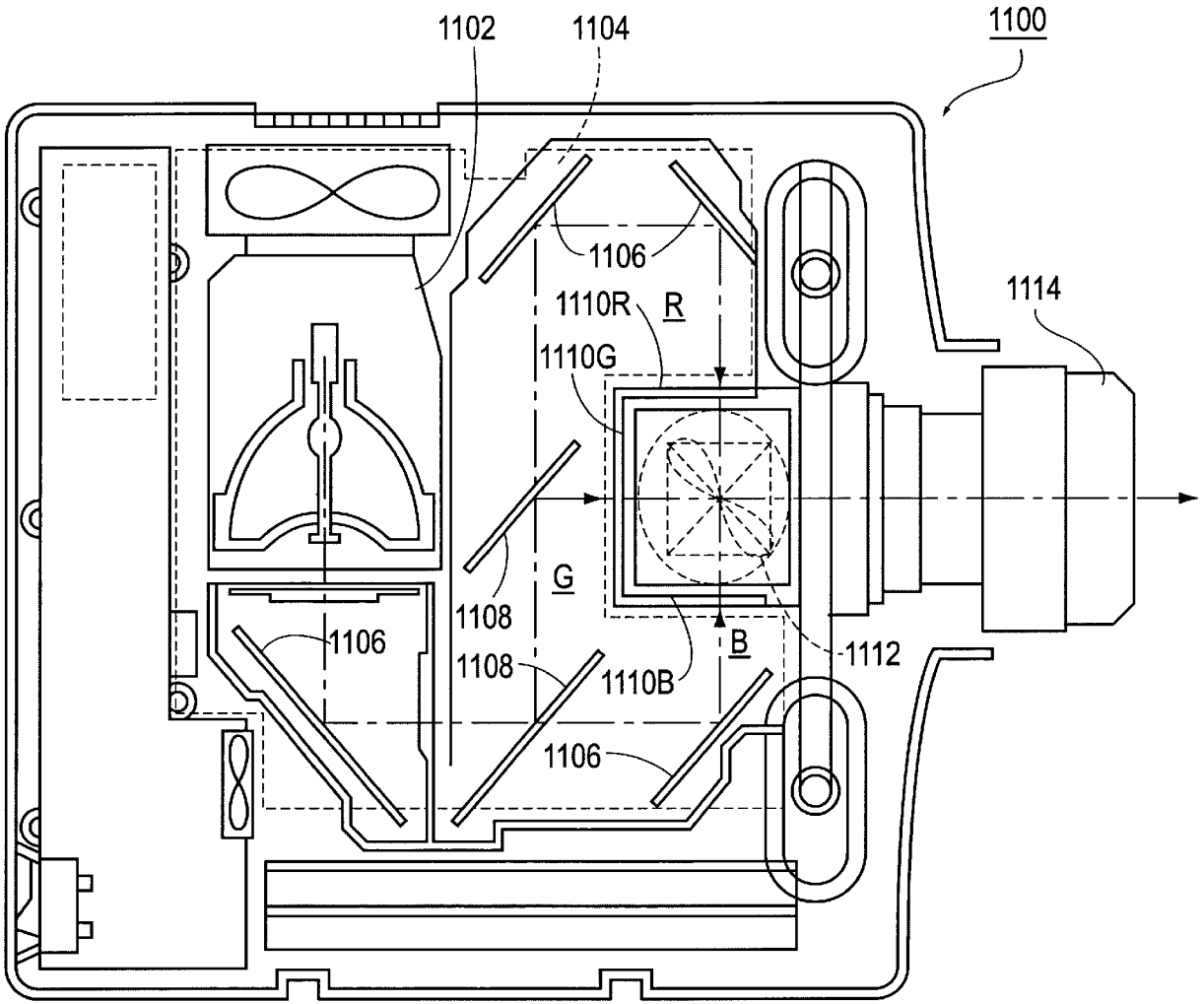
FIG. 9 is a schematic diagram of a projector to which the present invention is applied.
Figure 10:
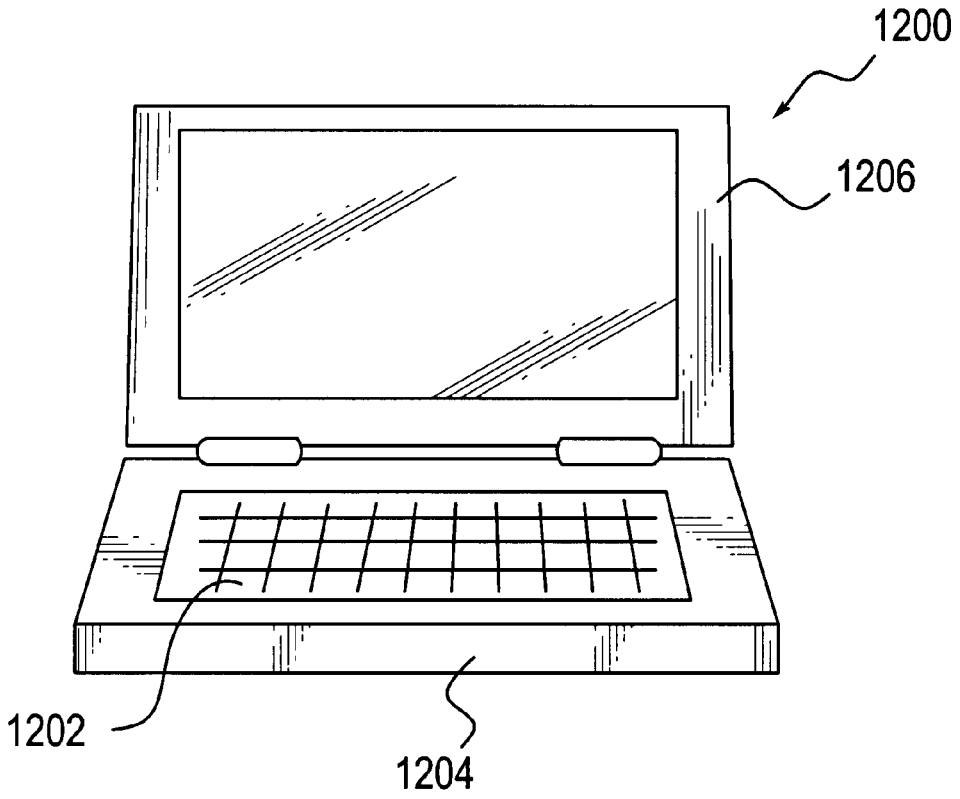
FIG. 10 is a schematic diagram of a personal computer (PC) to which the present invention is applied.

As electronic apparatuses having such structure, the projector shown in FIG. 9, the personal computer (PC) that is multimedia-ready and is shown in FIG. 10, an engineering workstation (EWS), and the like can be used.

The projector shown in FIG. 9 is a projection-type projector using transmissive liquid crystal panels as light valves, and uses, for example, a three-panel-and-prism-type optical system. In FIG. 9, in the projector 1100, projected light emitted from a lamp unit 1102 of a white light source is divided into three primary colors of R, G, and B by a plurality of mirrors 1106 and two dichroic mirrors 1108 inside a light guide 1104, and light modulated by three active matrix liquid crystal panels 1110R, 1110G, and 1110B that display images in respective colors is directed from three directions into a dichroic prism 1112.

Since, in the dichroic prism 1112, light of red R and blue B is deflected at 90° and light of green G goes straight, images of respective colors are synthesized, and a color image is projected on a screen and the like through a projection lens 1114. Here, although the projection-type projector is described in the drawing as an example, the present invention is not limited to this, but it is possible to apply the display device of the present invention to a reflection-type projector and a transmissive liquid crystal display device.

The personal computer 1200 shown in FIG. 10 may include the above-described invention and has a main unit 1204 comprising a keyboard 1202, and a liquid crystal display screen 1206.

In addition, the present invention is not limited to the above-described embodiment, but various modifications can be performed without departing from the essential points of the present invention. For example, the present invention can be applied also to another display device not using a liquid crystal panel in case fluctuation of emission intensity during adjustment of gradation of a display device becomes a problem. In addition, the present invention can be applied to a display device besides a projector also in the case of using a liquid crystal panel as a light valve.

Furthermore, although an example using TFTs as switching elements for pixels is described in the above-described embodiment, two-terminal elements such as MIMs also can be used as switching elements. In this case, since a pixel includes the two-terminal element and a liquid crystal cell being directly connected between a scanning signal line and a data signal line, a differential voltage between both signal lines is supplied to the pixel.

Moreover, although, in the above-described embodiment, TFTs are used as switching elements and a substrate on which elements of the liquid crystal panel are formed is a substrate made of glass or quartz, a semiconductor substrate also can be used instead of this substrate.

In a luminance adjustment method of a second embodiment, adjustment of measured data is performed by directly measuring light leaking from a light source in a display device, for example, a projector.

Thus, this method is for performing luminance adjustment by measuring the luminance of light before passing through a display panel through measuring light leaking from a light source incorporated in the projector and measuring the luminance of light passing through the display panel through measuring light projected on the projector screen.

Figure 11:
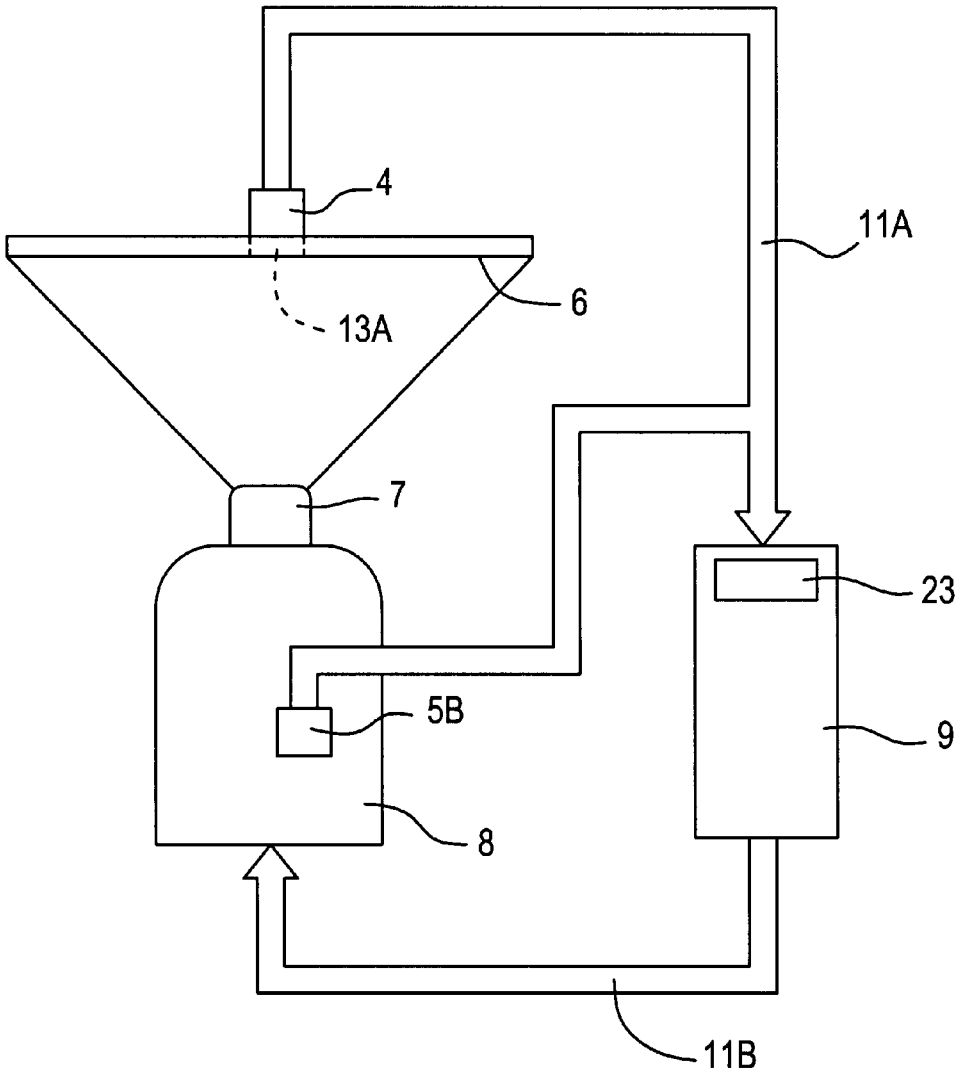
FIG. 11 is a schematic diagram of a luminance-measuring instrument for measuring the applied voltage vs optical power characteristic of a second embodiment applying the present invention to a projector.

FIG. 11 shows a schematic diagram of a luminance-measuring instrument for a display device according to the second embodiment. Similarly to the first embodiment, in the luminance measurement of a display device, for example, a projector according to the second embodiment, measurement is performed every R, G, or B, this measurement is performed using the gradation-value-measuring instrument 9, and sensor 4 and reference sensor 5B and projecting an image on the projector screen 6 from the projector 8 through the lens 7.

At this time, similarly to the first embodiment, light-passing means 13A is provided in the center part of the projector screen 6 and the screen 6 is located so that light from the projector 8 may be directed to the sensor 4.

On the other hand, the reference sensor B is provided so that the light leaking from the light source in the projector 8 may be directed into the reference sensor 5B so as to measure the luminance of the light before the light passes through the display panel. Although this installation location is not shown, this is installed so that the reference sensor 5B may be positioned nearer to the light source than the display panel. For example, since adjustment according to the present invention is performed as one process step of a manufacturing process before factory shipping, it is also possible to locate the reference sensor 5B nearer to the light source than the display panel, but it is also possible to perform the above-described measurement after manufacturing the projector in the state of incorporating the reference sensor 5B beforehand at the above-described position. FIG. 11 shows the latter case as an example.

In addition, a device having the same specification as the sensor 4 is used as the reference sensor 5B, and a single clock signal is simultaneously taken in the reference sensor 5B and sensor 4.

The sensor 4 and reference sensor 5B are connected to the gradation-value-measuring instrument 9 through cable 11A, measured data in the sensor 4 and reference data measured in the reference sensor 5B are inputted every measurement respectively to the gradation-value-measuring instrument 9, and correction of the measured data and luminance-gradation value conversion that are performed in the first embodiment are performed.

Then, similarly to the first embodiment, measurement of luminance of the light source is performed by changing the gradation of the light source in the projector, measuring luminance at each gradation in the sensor 4, and simultaneously measuring luminance as each reference in the reference sensor 5B.

In the luminance measurement, the measured data Mes obtained every measurement and the reference data Ref are supplied to the gradation-value-measuring instrument 9 by light incident to the sensor 4 and reference sensor 5B being outputted as an electric signal to the first data bus formed with the cable 11A and being inputted to the gradation-value-measuring instrument 9.

Furthermore, each corrected-gradation value Lux is calculated by correcting each measured data Mes described above with using the same method as that in the first embodiment on the basis of each reference data Ref described above, each corrected-gradation value Data is calculated by normalizing the value Lux, and this corrected-gradation value Data is outputted to the second data bus formed with the cable 11B and is fed back to the projector 8.

Moreover, in the data correction circuit 23 mounted in the gradation-value-measuring instrument 9, after each measured data Mes described above is corrected on the basis of the correction vale calculated from the reference data Ref and each corrected luminance value Lux, is calculated, each corrected-gradation value Data is calculated with normalizing the value Lux. Further each corrected-gradation value Data described above is inputted to the gamma correction circuit 32 shown in FIG. 1, and thereby gamma correction is performed to the applied-voltage vs optical power characteristic on the basis of this corrected-gradation value Data.

Since an instrument similar to that of the first embodiment is used as the gradation-value-measuring instrument in FIG. 11, an extraction method of each corrected luminance value from each measured data is the same method as that in the first embodiment.

Here, since the data processor shown in FIG. 5 can be used because the data processor is configured similarly to that in the first embodiment, explanation is omitted, but, also in the second embodiment, correction similar to that in the first embodiment is performed by using reference data to each measured data through performing not only measurement by the sensor 4 but also measurement by the reference sensor 5B simultaneously at the time of luminance measurement. Therefore, it is also possible to perform in real time the calculation calculating a corrected luminance value by correcting the reference data and measured data.

Therefore, also with the adjustment method of the second embodiment, it becomes possible to give suitable gamma correction data by calculating a correction value of the measured data Mes with reference to the reference data Ref and performing normalization on the basis of data corrected using this correction value. Also in this correction method of measured data, it is possible to obtain the corrected luminance value Lux from the measured data Mes by applying the method (1) or (2) described in the first embodiment and therein executing calculation of formulas 4 through 7, 8 through 12, or 13 through 16.

Thus, by applying this adjustment method, this embodiment is for calculating the corrected-gradation values as data stored in a memory unit in the display device by correcting the measured data on the basis of the reference data, which are measured by the reference sensor, and measured data, and normalizing the data after correction. In addition, it is apparent that a circuit similar to that in the first embodiment is applicable also to the data correction circuit in the display device. Furthermore, a display device to which this second embodiment is applied can be applied to the projection-type display device, electronic apparatus, and the like that are shown in the first embodiment.

Hereinbefore, the adjustment method of a display device is described, but, in consideration of fluctuation of a transmittance ratio due to material of a panel, the first embodiment is superior in performing high-precision adjustment in a respect of taking light passing through a liquid crystal panel as a reference.

Figure 12:
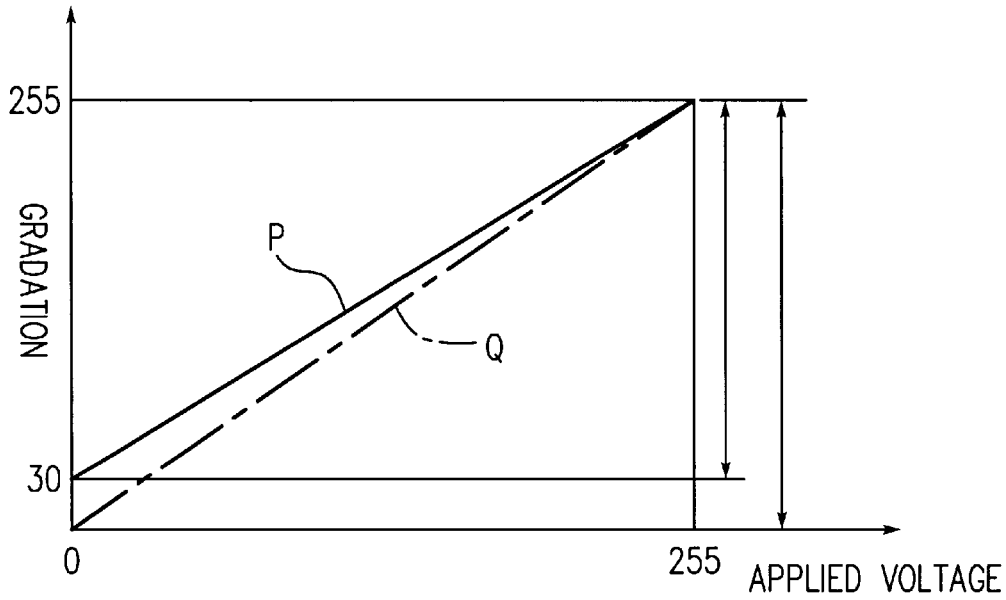
FIG. 12 is an example of a graph showing the applied voltage vs optical power characteristic after gamma correction.

In a display device, there is a possibility of voltage amplitude between white and black potentials becoming small. For example, as a graph showing the applied-voltage vs gradation characteristic after gamma correction in FIG. 12 shows, black display becomes 30 if the corrected-gradation value of the white display is defined to be 255. Therefore, in order to realize a higher-precision display device, finally, adjustment of voltage amplitude is indispensable, and contrast adjustment or dynamic-range adjustment becomes necessary. For example, in the example of FIG. 12, by changing the characteristic P to the characteristic Q to extend voltage amplitude, it becomes possible to increase the contrast ratio.

In this contrast adjustment, by performing gain adjustment of an image signal and adjustment of a reference voltage in a DA converter using the following three methods, it becomes possible to increase the contrast ratio through extending the dynamic range of black and white levels, and two methods shown as items (3) and (4) are listed as methods therefor.

(3) To adjust a bias after digital-analog conversion (4) To adjust the reference voltage of the DA converter Furthermore, a method shown in item (5) is listed as a method of DC offset adjustment (white-balance adjustment).

(5) To adjust, for example, the black level of the clamp circuit

The methods (3) and (4) are for adjusting voltage amplitudes VA and VB, and the method (5) is DC level adjustment and is for adjusting voltage amplitudes VC and VD. Hereinafter, methods (3) through (5) will be described separately.

Figure 13:
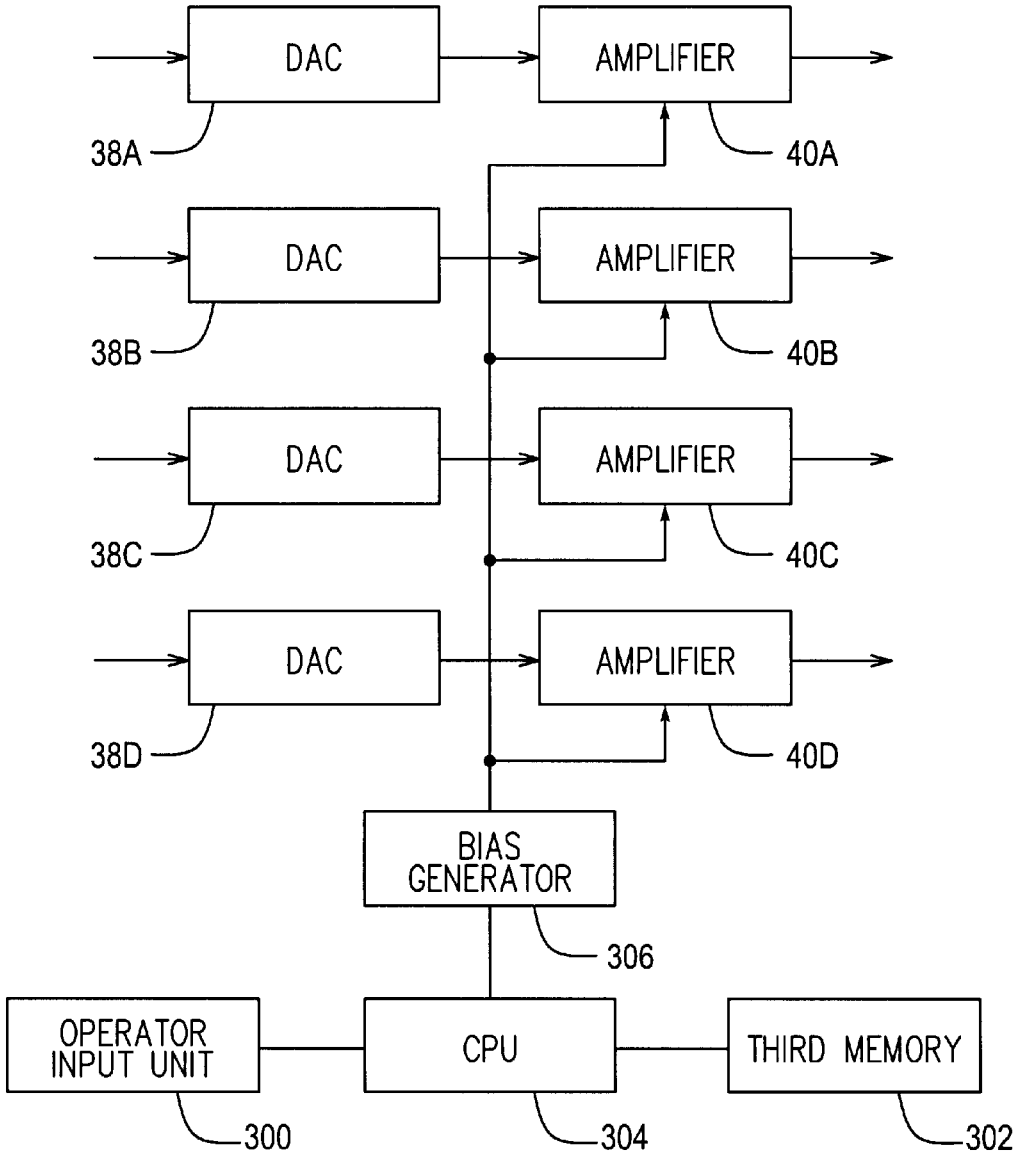
FIG. 13 is a block diagram showing an adjusting device for performing bias adjustment after digital-analog conversion.

FIG. 13 shows a block diagram of an adjusting device performing bias adjustment after digital-analog conversion.

The adjusting device in FIG. 13 has an operator input unit 300 for inputting data for adjustment of gamma correction data, a memory unit where applied-voltage vs transmittance ratio characteristics of respective panels are stored, for example, third memory 302 that is rewritable and non-volatile, and a CPU 304 calculating various adjustment data on the basis of information from the operator input unit 300 and third memory 302. In addition, these operator input unit 300, third memory 302, and CPU 304 are incorporated in adjusting equipment installed in a factory because these adjustments are possible in the stage of factory shipment.

In the adjustment process before factory shipment of this device, the appliedvoltage vs optical power characteristic of each of display panels 50R, 50G, and 50B is measured, and is stored in the third memory 302. After that, a predetermined pattern is displayed on display panels 50R, 50G, and 50B, and is observed on the panels or a projector screen where R, G, and B are synthesized, for example, in visual observation to perform inspection. Furthermore, this adjusting device has a bias generator 306 changing a bias voltage superimposed in the amplifier 40 on the basis of a command from the CPU 304. In addition, the operator input unit 300 has an operation unit for adjustment of a dynamic range, and a command of bias voltage change is issued from the CPU 300 to the bias generator 306 on the basis of inputting from the operation unit or automatically.

Figure 14:
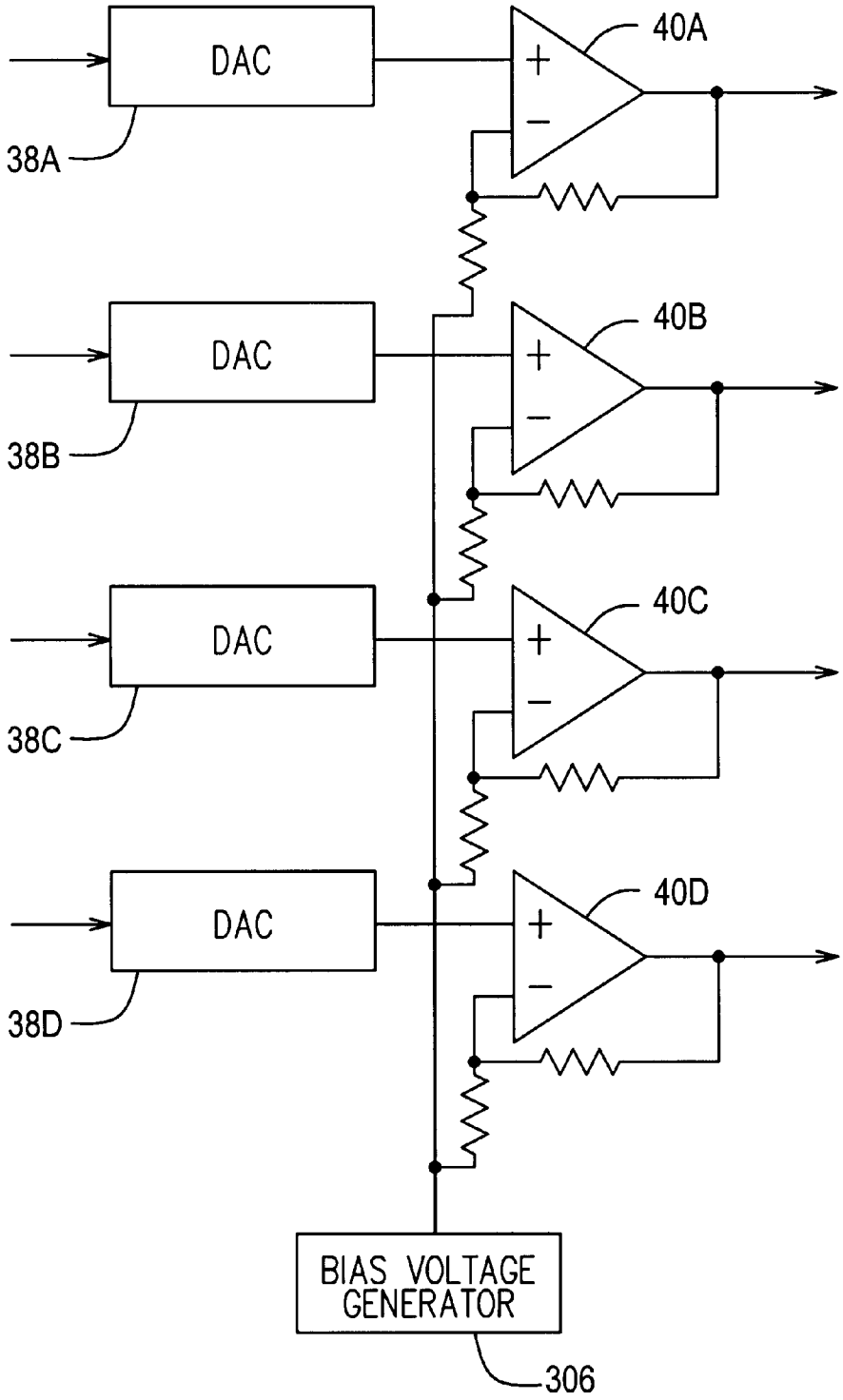
FIG. 14 is a block diagram showing the circuit structure of an amplifier in the case of four-phase development.

Here, the structure of the amplifier 40 is shown in FIG. 14.

FIG. 14 shows the circuit structure of the amplifier 40 in the case of four phase development that is N=4. Operational amplifiers 40A through 40D are connected to four DA converters 38A through 38D. Then, an output of the bias generator 306 is commonly connected to bias input lines of four operational amplifiers 40A through 40D.

In this manner, with using the adjusting device shown in FIG. 13, it becomes possible to perform the bias adjustment by operation input after digital-analog conversion, to perform the gain adjustment of an image signal, and to extend the voltage amplitude.

Figure 15:
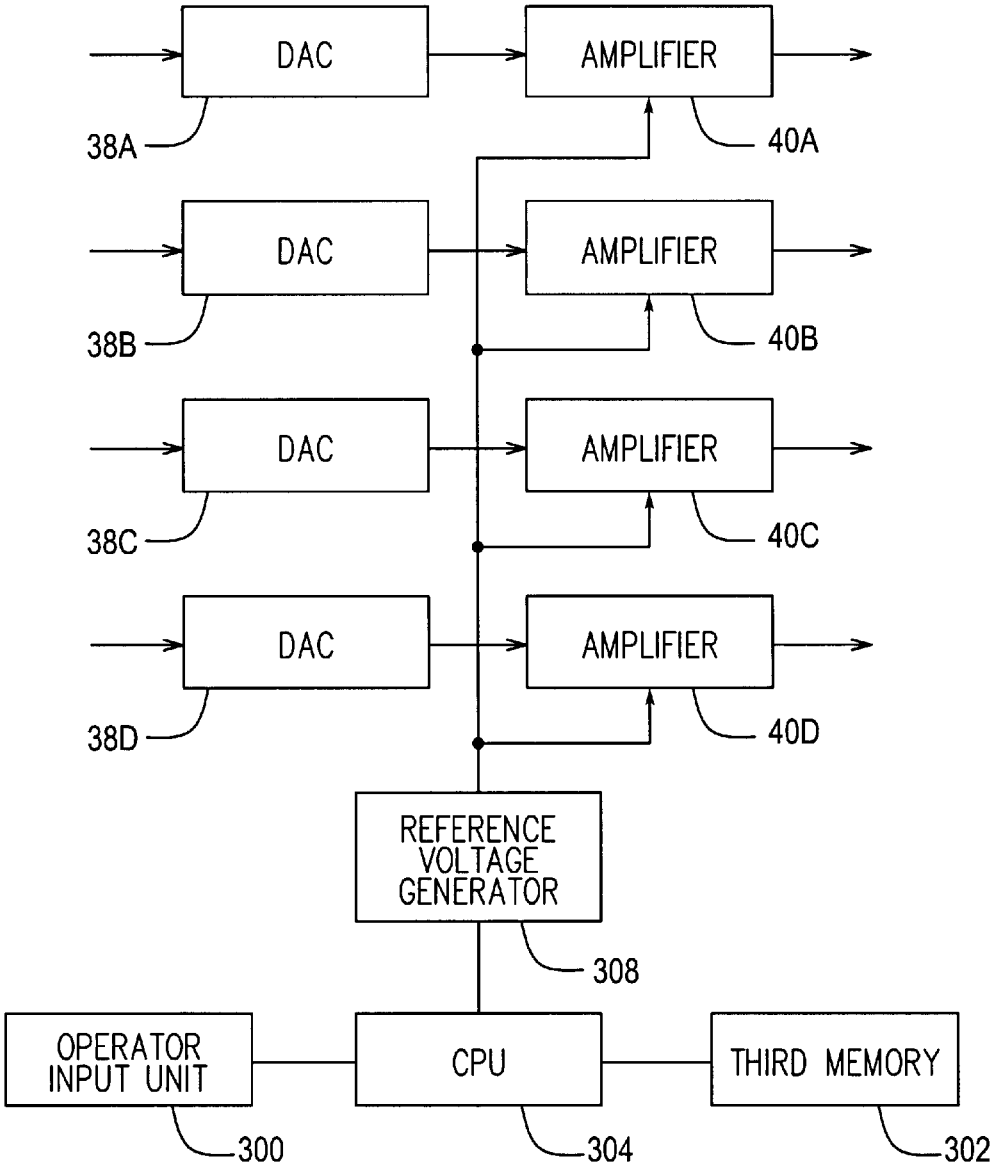
FIG. 15 is a block diagram showing an adjusting device for widening a narrow dynamic range through adjusting a reference voltage of a DA converter.

FIG. 15 shows an adjusting device for extending a narrow dynamic range with adjusting a reference voltage of the digital-analog converter.

In the adjusting device of FIG. 15, a reference voltage generator 308 changing the reference voltage of the DA converter 38 is provided instead of the bias generator of FIG. 13. Owing to this, the command of reference voltage change is issued by the CPU 300 to the reference voltage generator 308 on the basis of an operation input of the operator input unit 300 or automatically. Furthermore, also in FIG. 15, the structure shown in FIG. 14 can be applied to that in the amplifier 40.

In this manner, the reference voltage of the DA converter can be adjusted by operation input with using the adjusting device of FIG. 15, and hence it becomes possible to extend the voltage amplitude.

Figure 16:
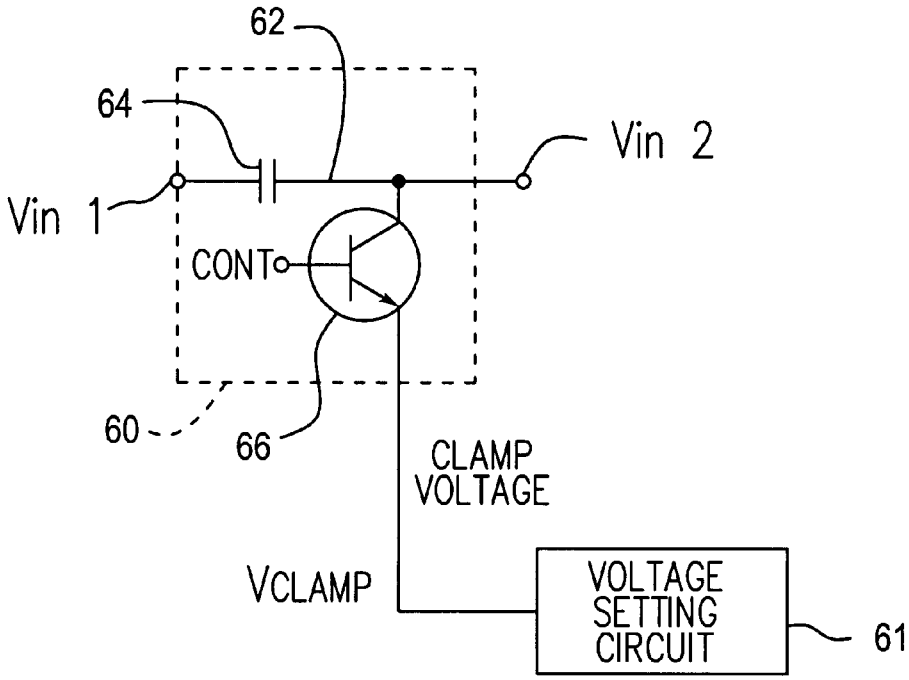
FIG. 16 is a block diagram showing an adjusting device for adjusting a clamp level, for example, a black level.
Figure 17:
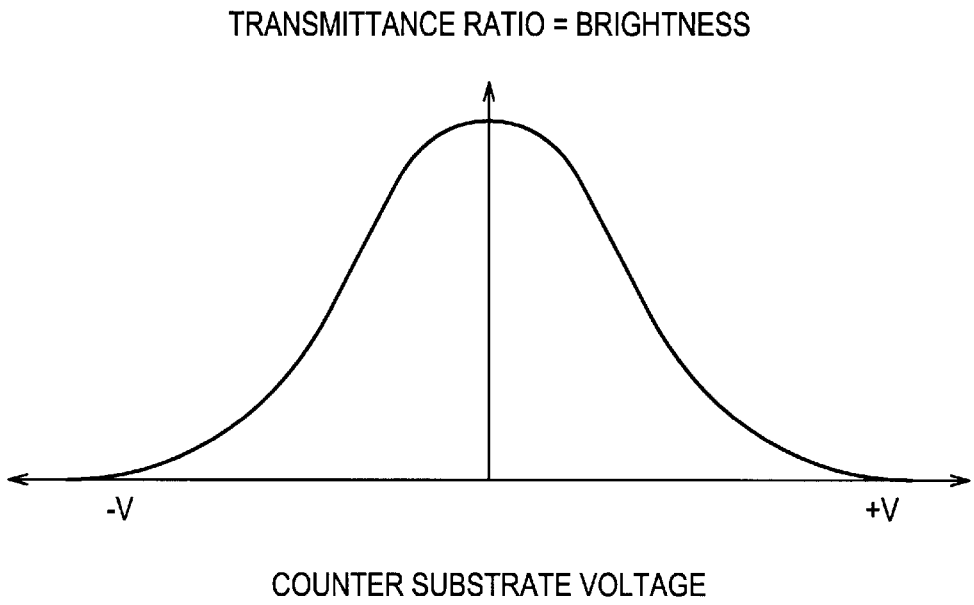
FIG. 17 is a graph showing the relationship between the differential voltage between the voltage V (positive-polarity voltage: +, negative-polarity voltage: −) and counter substrate voltage, and the transmittance ratio.
Figure 18:
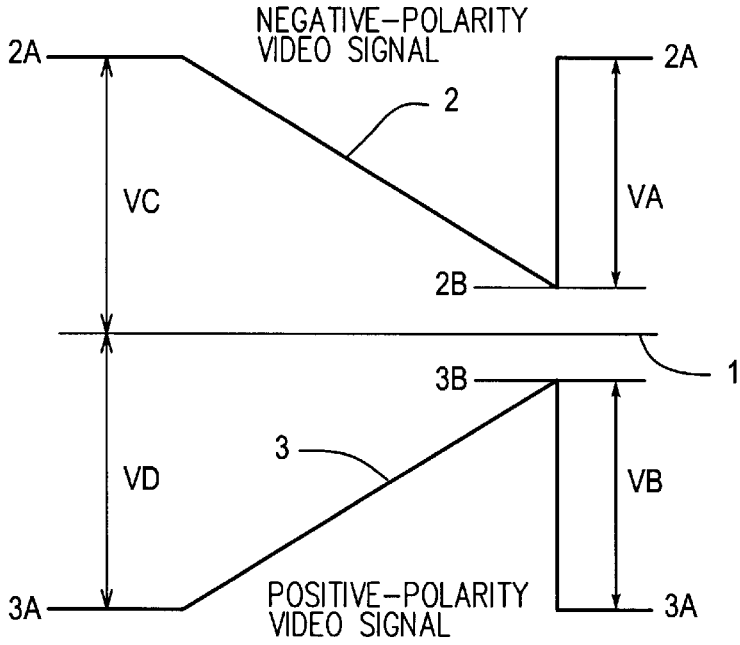
FIG. 18 is a graph showing changes of a signal voltage at the time of inverting the polarity of a voltage applied to liquid crystal and driving the liquid crystal.

FIG. 16 shows an adjusting device adjusting, for example, a black level in a clamp circuit.

The adjusting device of FIG. 16 is the clamp circuit 60 and voltage setting circuit 61, and is a circuit provided after the DA converter in FIG. 1.

The clamp circuit 60 has a signal line 62 where an image signal Vinl is inputted, and a charging capacitor 64 and a charge drive transistor 66 that are connected in the midst of the signal line. A clamp voltage $V_{CLAMP}$ is applied to the emitter of a charging transistor 66, and its collector is connected to the signal line 62. A clamp control signal CONT is inputted to the base of the charging transistor.

The image signal Vin1 is a signal changing between the white and black levels, and for example, let the white level be 5 V, and let the black level be 2 V. The control signal inputted to the base of the charge drive transistor 66 in the clamp circuit 60 becomes logic "H" while it is a vertical interval or a horizontal interval before this 5 image signal Vinl is inputted and the black level is inputted to the signal line 62. At this time, the charge drive transistor 66 is turned on, and the clamp voltage $V_{CLAMP}$ is charged in the charging capacitor 64. After this, the control signal CONT becomes logic "L", and the charging transistor 66 is turned off. Hereinafter, when the image signal Vinl is inputted, the signal is clamped at the black level clamp voltage VCLAMP.

The clamp voltage $V_{CLAMP}$ of an image signal Vin2 outputted from the clamp circuit 60 is, for example, 1.2 V, and with comparing to the image signal Vin1, the black level is lower, but the amplitude between the black and white levels is the same, for example, 3 V.

In this manner, it is possible to set the clamp voltage of the clamp circuit at a black level with the adjusting device of FIG. 16, and hence, since it is possible to change a white level also in company with this, white balance adjustment is performed by executing this adjustment upon each of panels R, G, and B.

Hereinbefore, although the contrast adjustment and white balance adjustment were described, these methods are performed after adjustments of the first and second embodiments, and it becomes possible to further increase image quality of the display device with using this method.

Figure 20:
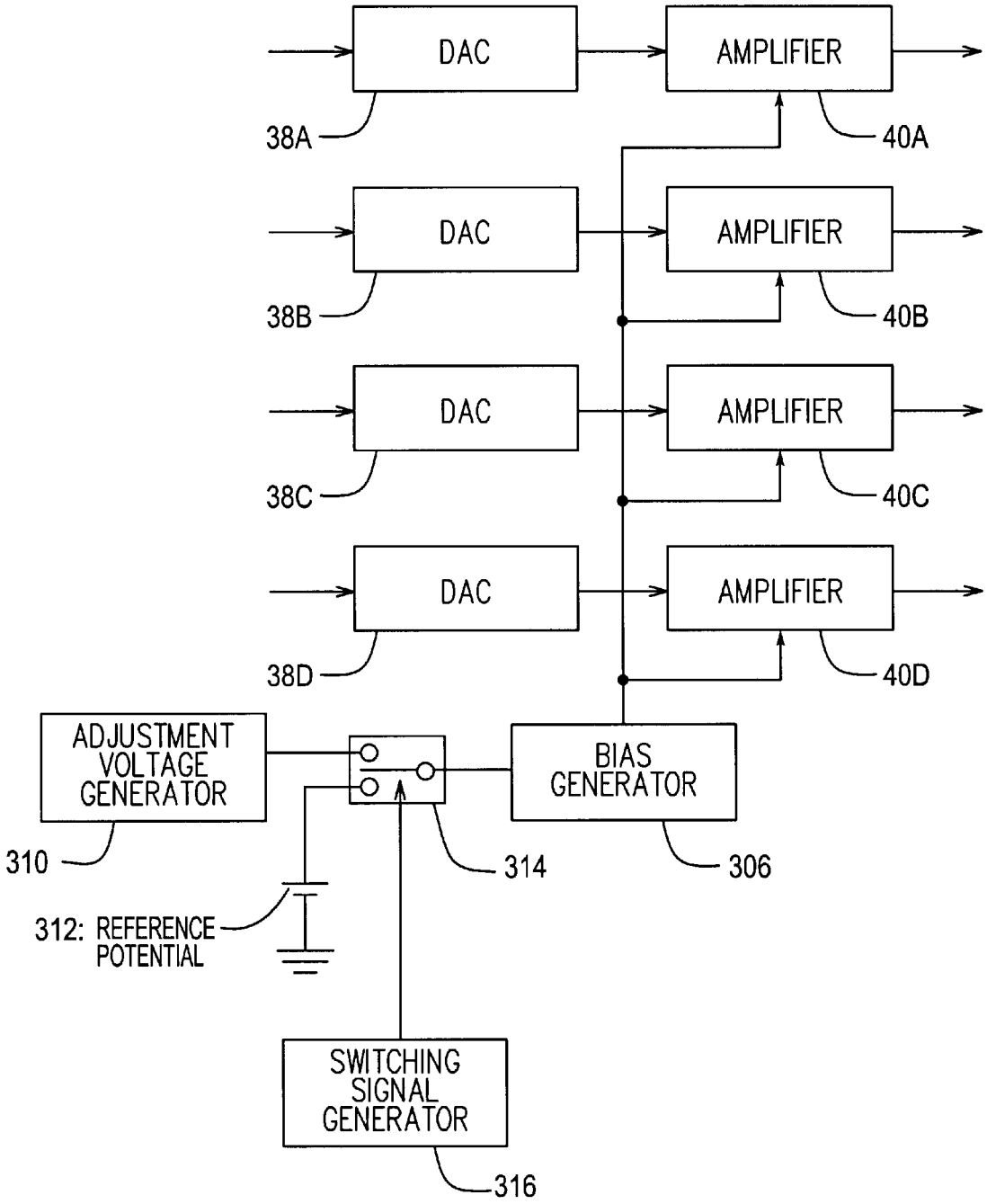
FIG. 20 is a block diagram showing a circuit capable of displaying only the area of an opening 13A among display patterns, shown in FIG. 1(B), at a gradation value different every measurement in spite of supplying pixel data at a constant gradation in each measurement.

FIG. 20 is a block diagram showing the structure of a main part for obtaining a display pattern shown in FIG. 1(B). Among circuits shown in FIG. 20, DACs 38A through 38D, amplifiers 40A through 40D, and bias circuit 306 are the same as those in FIG. 14. In FIG. 20, further, an adjustment voltage generator 310, a reference potential 312, a switch 314, and a switching signal generator 316 are provided.

Figure 21A:
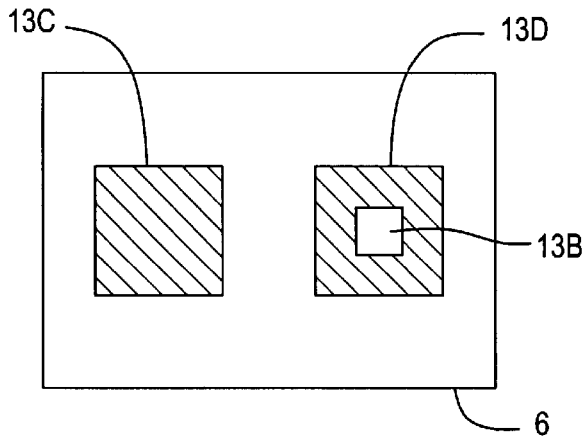
FIG. 21(A) is a drawing showing display patterns based on pixel data in a constant gradation that is supplied at the time of each measurement.

Operation of circuits of FIG. 20 will be described with reference to FIGS. 21(A) and 21(B). Pixel data corresponding to a display pattern shown in FIG. 21(A) is outputted from the DACs 38A through 38D in FIG. 20. The difference from the display pattern at the time of measurement that is shown in FIG. 1(B) is an area corresponding to the opening 13A is a black display that is the same as a mask area 13C that is the vicinity thereof.

Here, when the reference potential 312 is supplied to the bias generator 306 through the switch 314, the display pattern shown in FIG. 21(A) is projected on the projector screen 6. Nevertheless, it is not possible to display gradation values, which are different for every measurement, in the area of the opening 13A as it is.

Then, only when display is performed in the area corresponding to the opening 13A, the switch 314 is switched to supply the potential from the adjustment voltage generator 310 to the bias generator 306 through the switch 314. Different potentials corresponding to gradation values, which are different every measurement are generated at the area of the opening 13A from this adjustment voltage generator 310. In this manner, only when the pixel data corresponding to the area of the opening 13A is amplified by the amplifiers 40A through 40D, black display data outputted from the DACs 38A through 38D are amplified by the amplifiers 40A through 40D so that the data may become gradation values that are different every measurement. Owing to this, the pixel data supplied to a liquid crystal panel at the time of measurement is fixed in a constant pattern shown in FIG. 21(A) while only the gradation value in the area of the opening 13A can be changed.

Figure 21B:
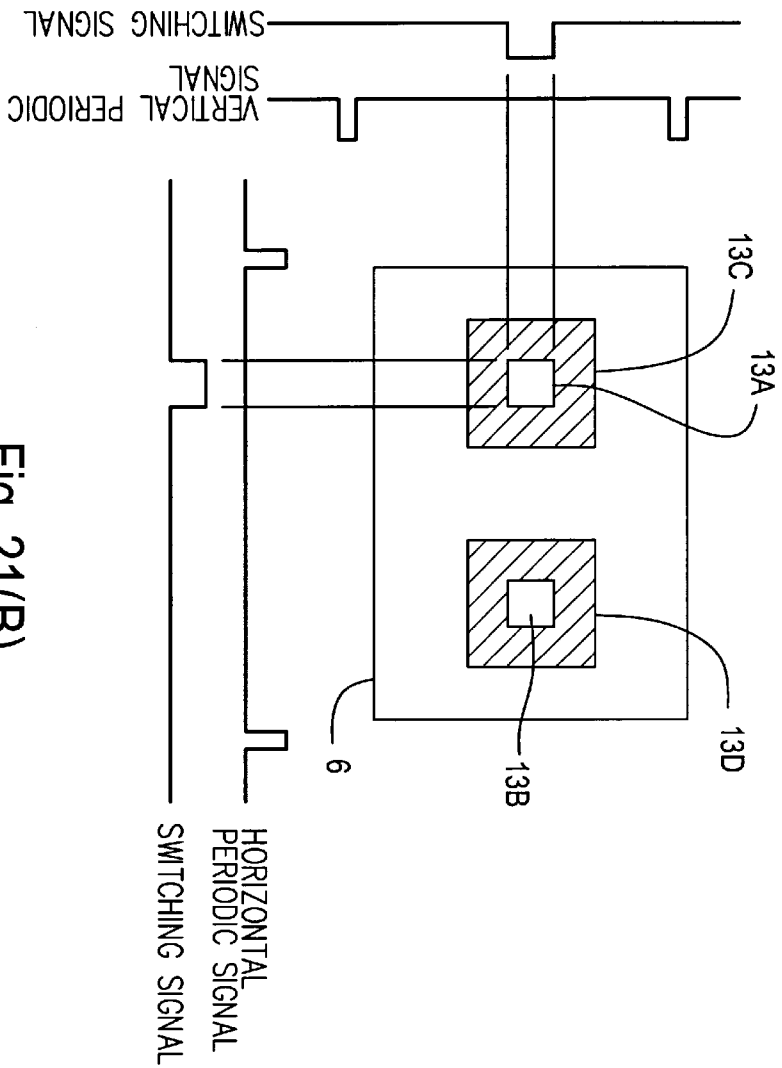
FIG. 21(B) is a drawing showing the display patterns that can be obtained by switching a switch in FIG. 20 are the same ones as those shown in FIG. 1(B).

Since the switch 314 is switched only when the display is performed in the area corresponding to the opening 13A, a switching signal shown in FIG. 21(B) is generated from the switching signal generator 316.

What is claimed is:

1. An adjustment method of a display device having a light source and an optical modulator modulating light from said light source on the basis of an applied voltage, said adjustment method comprising:

a first step of changing and setting said applied voltage according to different gradation values and measuring an optical power at each of the gradation values that is modulated by said optical modulator at a position corresponding to at least a first pixel;

a second step of setting an applied voltage, corresponding to a constant gradation value, every measurement in said first step and measuring a reference optical power modulated by said optical modulator at a reference position corresponding to a second pixel, the reference position being different from the position corresponding to at least a first pixel; and a third step of correcting the optical power at each of the gradation values, which is measured in said first step, on the basis of said reference optical power measured in said second step.

2. The adjustment method of a display device according to claim 1, wherein, in said second step, said reference optical power is measured at a maximum gradation value.

3. The adjustment method of a display device according to claim 2, wherein said display device comprises a plurality of types of optical modulators and said measurement is performed for every optical modulator.

4. The adjustment method of a display device according to claim 1, wherein said third step includes comparing the reference optical power measured at the time of a first measurement and respective reference optical power measured at the time of respective measurements after the first measurement and calculating respective correction values based on the comparison.

5. The adjustment method of a display device according to claim 1, wherein said third step includes comparing a mean value of the reference optical power measured during respective measurements with the values of respective reference optical power obtained at the time of respective measurements and calculating respective correction values based on the comparison.

6. The adjustment method of a display device according to claim 1, wherein said third step includes comparing an initial value of the reference optical power defined as a standard reference optical power with respective reference optical powers obtained at the time of respective measurements and calculating respective correction values based on the comparison.

7. The adjustment method of a display device according to claim 1, wherein said third step includes converting said corrected optical power into a gradation value.

8. The adjustment method of a display device according to claim 7, further comprising a fourth step of determining a gamma characteristic on the basis of respective correction values obtained in said third step.

9. The adjustment method of a display device according to claim 8, further comprising:

a step of correcting digital data in a gamma correction circuit where said gamma correction characteristic is set and where input data is changed into said digital image data for application to an applied voltage vs optical modulation characteristic in said optical modulator;

a step of converting said digital image data into analog image data with a DA converter;

a step of amplifying said analog image data with an amplifier;

a step of displaying an image by driving said optical modulator for modulation on the basis of said analog image data; and an adjustment step of extending a dynamic range of a display image by changing an amplification factor in said amplifier when a gradation value of input digital image data to said gamma correction circuit is a largest value and a gradation value of output digital image data from said gamma correction circuit is smaller than the largest value.

10. The adjustment method of a display device according to claim 9, wherein said amplifier comprises an operational amplifier, further comprising changing a bias potential supplied to said operational amplifier at said adjustment step.

11. The adjustment method of a display device according to claim 8, said method further comprising:

a step of correcting digital data in a gamma correction circuit where said gamma correction characteristic is set and where input data is changed into digital image data for application to an applied voltage vs optical modulation characteristic in said optical modulator;

a step of converting said digital image data, which is corrected by said gamma correction circuit, into analog image data with a DA converter on the basis of a reference voltage;

a step of amplifying said analog image data with an amplifier;

a step of displaying an image by driving said optical modulator for modulation on the basis of said analog image data; and an adjustment step of extending a dynamic range of a display image by changing said reference voltage of said DA converter when a gradation value of input digital image data to said gamma correction circuit is a largest value and a gradation value of output digital image data from said gamma correction circuit is smaller than the largest value.

12. An adjustment method of a display device according to claim 8, said method further comprising:

a step of correcting digital data in a gamma correction circuit where said gamma correction characteristic is set and where input data is changed into digital image data for application to an applied voltage vs optical modulation characteristic in said optical modulator;

a step of converting said digital image data, which is corrected by said gamma correction circuit, into analog image data with a DA converter on the basis of a reference voltage;

a step of setting a voltage corresponding to a smallest gradation value among said analog image data at a predetermined clamp voltage in a clamp circuit;

a step of displaying an image by driving said optical modulator for modulation on the basis of said analog image data; and a step of adjusting a white balance by changing a clamp voltage in said clamp circuit and hence adjusting a DC offset amount of said analog image data to the reference voltage.

13. The adjustment method of a display device according to claim 1, wherein said display device is a projection-type display device, the measurement at said first step is performed for pixels on a display screen, and the measurement at said second step is performed for pixels at said reference positions on said screen.

14. An adjustment method of a display device having a light source and an optical modulator modulating light from said light source on the basis of an applied voltage, said method comprising:

a first step of changing and setting said applied voltage according to different gradation values and measuring an optical power at each of the gradation values that is modulated by said optical modulator at a position corresponding to at least one pixel;

a second step of measuring a reference optical power from said light source for every measurement in said first step; and a third step of correcting the optical power at each of the gradation values that is measured in said first step on the basis of said reference optical power measured in aid second step.

15. The adjustment method of a display device according to claim 14, wherein light from said light source is measured in said second step using a measuring device located inside said display device.

16. The adjustment method of a display device according to claim 14, wherein said third step includes comparing the reference optical power measured at the time of a first measurement and respective reference optical power measured at the time of respective measurements after the first measurement and calculating respective correction values based on the comparison.

17. The adjustment method of a display device according to claim 14, wherein said third step includes comparing a mean value of the reference optical power measured during respective measurements with the values of respective reference optical power obtained at the time of respective measurements and calculating respective correction values based on the comparison.

18. The adjustment method of a display device according to claim 14, wherein said third step includes comparing an initial value of the reference optical power defined as a standard reference optical power with respective reference optical powers obtained at the time of respective measurements and calculating respective correction values based on the comparison.

19. The adjustment method of a display device according to claim 14, wherein said third step includes converting said corrected optical power into a gradation value.

20. The adjustment method of a display device according to claim 19, further comprising a fourth step of determining a gamma characteristic on the basis of respective correction values obtained in said third step.

21. The adjustment method of a display device according to claim 20, further comprising:

a step of correcting digital data in a gamma correction circuit where said gamma correction characteristic is set and where input data is changed into said digital image data for application to an applied voltage vs optical modulation characteristic in said optical modulator;

a step of converting said digital image data into analog image data with a DA converter;

a step of amplifying said analog image data with an amplifier;

a step of displaying an image by driving said optical modulator for modulation on the basis of said analog image data; and an adjustment step of extending a dynamic range of a display image by changing an amplification factor in said amplifier when a gradation value of input digital image data to said gamma correction circuit is a largest value and a gradation value of output digital image data from said gamma correction circuit is smaller than the largest value.

22. The adjustment method of a display device according to claim 21, wherein said amplifier comprises an operational amplifier, further comprising changing a bias potential supplied to said operational amplifier at said adjustment step.

23. The adjustment method of a display device according to claim 20, said method further comprising:

a step of correcting digital data in a gamma correction circuit where said gamma correction characteristic is set and where input data is changed into digital image data for application to an applied voltage vs optical modulation characteristic in said optical modulator;

a step of converting said digital image data, which is corrected by said gamma correction circuit, into analog image data with a DA converter on the basis of a reference voltage;

a step of amplifying said analog image data with an amplifier;

a step of displaying an image by driving said optical modulator for modulation on the basis of said analog image data; and an adjustment step of extending a dynamic range of a display image by changing said reference voltage of said DA converter when a gradation value of input digital image data to said gamma correction circuit is a largest value and a gradation value of output digital image data from said gamma correction circuit is smaller than the largest value.

24. An adjustment method of a display device according to claim 20, said method further comprising:

a step of correcting digital data in a gamma correction circuit where said gamma correction characteristic is set and where input data is changed into digital image data for application to an applied voltage vs optical modulation characteristic in said optical modulator;

a step of converting said digital image data, which is corrected by said gamma correction circuit, into analog image data with a DA converter on the basis of a reference voltage;

a step of setting a voltage corresponding to a smallest gradation value among said analog image data at a predetermined clamp voltage in a clamp circuit;

a step of displaying an image by driving said optical modulator for modulation on the basis of said analog image data; and a step of adjusting a white balance by changing a clamp voltage in said clamp circuit and hence adjusting a DC offset amount of said analog image data to the reference voltage.

25. The adjustment method of a display device according to claim 14, wherein said display device is a projection-type display device, the measurement at said first step is performed for pixels on a display screen, and the measurement at said second step is performed for pixels at said reference positions on said screen.

* * * * *